US007214884B2

(12) United States Patent
Kenny et al.

(10) Patent No.: US 7,214,884 B2
(45) Date of Patent: May 8, 2007

(54) CABLE WITH OFFSET FILLER

(75) Inventors: Robert Kenny, Centennial, CO (US); Stuart Reeves, Glos (GB); Keith Ford, Glos (GB); John W. Grosh, Centennial, CO (US); Spring Stutzman, Sidney, NE (US); Roger Anderson, Sidney, NE (US); David Wiekhorst, Sidney, NE (US); Fred Johnston, Sidney, NE (US)

(73) Assignee: ADC Incorporated, Centennial, CO (US)

( * ) Notice: Subject to any disclaimer, the term of this patent is extended or adjusted under 35 U.S.C. 154(b) by 0 days.

(21) Appl. No.: 10/746,800

(22) Filed: Dec. 26, 2003

(65) Prior Publication Data

US 2005/0092515 A1 May 5, 2005

Related U.S. Application Data

(60) Provisional application No. 60/516,007, filed on Oct. 31, 2003.

(51) Int. Cl.
*H01B 7/00* (2006.01)

(52) U.S. Cl. ..... 174/113 R; 174/113 C

(58) Field of Classification Search ..... 174/113 R, 174/113 C, 131 A, 113 AS
See application file for complete search history.

(56) References Cited

U.S. PATENT DOCUMENTS

| | | | | |
|---|---|---|---|---|
| 483,285 | A | | 9/1892 | Guilleaume |
| 1,389,143 | A | * | 8/1921 | Kempton ..... 138/141 |
| 1,475,139 | A | | 11/1923 | Pearson |
| 1,977,209 | A | | 10/1934 | Sargent |
| 2,204,737 | A | | 6/1940 | Swallow et al. |
| 2,556,244 | A | | 6/1951 | Weston |
| 2,583,026 | A | | 1/1952 | Swift |
| 2,804,494 | A | | 8/1957 | Fenton |
| 2,959,102 | A | | 11/1960 | Cook |
| 3,025,656 | A | | 3/1962 | Cook |
| 3,052,079 | A | | 9/1962 | Henning |
| 3,209,064 | A | | 9/1965 | Cutler |

(Continued)

FOREIGN PATENT DOCUMENTS

| | | |
|---|---|---|
| CA | 524452 | 5/1956 |

(Continued)

OTHER PUBLICATIONS

"Krone Product Data Sheet." 1 page (Jan. 16, 2001).

(Continued)

*Primary Examiner*—Chau N. Nguyen
(74) *Attorney, Agent, or Firm*—Merchant & Gould P.C.

(57) ABSTRACT

The present invention relates to cables made of twisted conductor pairs. More specifically, the present invention relates to twisted pair communication cables for high-speed data communications applications. A twisted pair including at least two conductors extends along a generally longitudinal axis, with an insulation surrounding each of the conductors. The conductors are twisted generally longitudinally along the axis. A cable includes at least two twisted pairs and a filler. At least two of the cables are positioned along generally parallel axes for at least a predefined distance. The cables are configured to efficiently and accurately propagate high-speed data signals by, among other functions, limiting at least a subset of the following: impedance deviations, signal attenuation, and alien crosstalk along the predefined distance.

22 Claims, 18 Drawing Sheets

U.S. PATENT DOCUMENTS 3,603,715 A 9/1971 Ellhardt et al.
3,621,118 A 11/1971 Bunish et al.
3,736,366 A 5/1973 Wittenberg
3,847,190 A 11/1974 Forester
3,921,381 A 11/1975 Vogelsberg
3,927,247 A 12/1975 Timmons
4,102,117 A 7/1978 Dornberger
4,263,471 A 4/1981 Bauguion
4,319,940 A 3/1982 Arroyo et al.
4,372,105 A 2/1983 Ellis, Jr.
4,408,443 A 10/1983 Brown et al.
4,413,469 A 11/1983 Paquin
4,654,476 A 3/1987 Barnicol-Ottler et al.
4,683,349 A 7/1987 Takebe
4,687,294 A 8/1987 Angeles
4,755,629 A 7/1988 Beggs et al.
4,807,962 A 2/1989 Arroyo et al.
5,042,904 A 8/1991 Story et al.
5,132,488 A 7/1992 Tessier et al.
5,177,809 A 1/1993 Zeidler
5,263,309 A 11/1993 Campbell et al.
5,286,923 A 2/1994 Prudhon et al.
5,289,556 A 2/1994 Rawlyk et al.
5,298,680 A 3/1994 Kenny
5,399,813 A 3/1995 McNeill et al.
5,424,491 A 6/1995 Walling et al.
5,493,071 A 2/1996 Newmoyer
5,514,837 A 5/1996 Kenny et al.
5,525,757 A 6/1996 O'Brien
5,535,579 A 7/1996 Berry, III et al.
5,544,270 A 8/1996 Clark et al.
5,564,268 A 10/1996 Thompson
5,565,653 A 10/1996 Rofidal et al.
5,574,250 A 11/1996 Hardie et al.
5,597,981 A 1/1997 Hinoshita et al.
5,600,097 A 2/1997 Bleich et al.
5,606,151 A 2/1997 Siekierka et al.
5,614,319 A 3/1997 Wessels et al.
5,659,152 A 8/1997 Horie et al.
5,706,642 A 1/1998 Haselwander
5,734,126 A 3/1998 Siekierka et al.
5,739,473 A 4/1998 Zerbs
5,742,002 A 4/1998 Arredondo et al.
5,744,757 A 4/1998 Kenny et al.
5,763,823 A 6/1998 Siekierka et al.
5,767,441 A 6/1998 Brorein et al.
5,770,820 A 6/1998 Nelson et al.
5,789,711 A 8/1998 Gaeris et al.
5,814,768 A 9/1998 Wessels et al.
5,821,466 A 10/1998 Clark et al.
5,902,962 A 5/1999 Gazdzinski
5,922,155 A 7/1999 Clouet et al.
5,952,607 A 9/1999 Friesen et al.
5,952,615 A 9/1999 Prudhon
5,966,917 A 10/1999 Thompson
5,969,295 A * 10/1999 Boucino et al. ..... 174/113 C
5,990,419 A 11/1999 Bogese, II
6,074,503 A 6/2000 Clark et al.
6,091,025 A 7/2000 Cotter et al.
6,096,977 A 8/2000 Beggs et al.
6,139,957 A 10/2000 Craton
6,150,612 A 11/2000 Grandy et al.
6,153,826 A 11/2000 Kenny et al.
6,194,663 B1 2/2001 Friesen et al.
6,211,467 B1 4/2001 Berelsman et al.
6,222,129 B1 4/2001 Siekierka et al.
6,222,130 B1 4/2001 Gareis et al.
6,248,954 B1 6/2001 Clark et al.
6,254,924 B1 7/2001 Brorein et al.
6,259,031 B1 7/2001 Totland et al.
6,297,454 B1 10/2001 Gareis
6,300,573 B1 10/2001 Horie et al.
6,318,062 B1 11/2001 Doherty
6,323,427 B1 11/2001 Rutledge
6,342,678 B1 1/2002 Knop et al.
6,348,651 B1 2/2002 Chou et al.
6,355,876 B1 3/2002 Morimoto
6,378,283 B1 4/2002 Barton
6,392,152 B1 5/2002 Mottine, Jr. et al.
6,433,272 B1 8/2002 Buhler et al.
6,452,094 B2 9/2002 Donner et al.
6,476,323 B2 11/2002 Beebe et al.
6,495,762 B2 12/2002 Arzate et al.
6,506,976 B1 1/2003 Neveux, Jr.
6,566,607 B1 5/2003 Walling
6,624,359 B2 9/2003 Bahlmann et al.
6,639,152 B2 10/2003 Glew et al.
6,684,030 B1 1/2004 Taylor et al.
6,770,819 B2 8/2004 Patel
6,787,697 B2 9/2004 Stipes et al.
6,800,811 B1 10/2004 Boucino
6,812,408 B2 11/2004 Clark et al.
6,818,832 B2 11/2004 Hopkinson et al.
6,855,889 B2 2/2005 Gareis
6,875,928 B1 4/2005 Hayes et al.
6,959,533 B2 11/2005 Noel et al.
2004/0055781 A1 3/2004 Cormibert et al.
2004/0149483 A1* 8/2004 Glew ..... 174/113 C
2004/0149484 A1 8/2004 Clark
2005/0006132 A1 1/2005 Clark
2005/0045367 A1 3/2005 Somers et al.
2005/0087361 A1 4/2005 Hayes et al.
2005/0103518 A1* 5/2005 Glew ..... 174/113 R
2005/0269125 A1 12/2005 Clark

FOREIGN PATENT DOCUMENTS

DE 68264 4/1893
DE 24 59 844 7/1976
EP 1 215 688 A1 6/2002
JP 5-101711 4/1993
JP 6-349344 12/1994
JP 2002-157926 5/2002
JP 2002-367446 12/2002
WO WO 01/41158 A1 6/2001

OTHER PUBLICATIONS

NORDX/CDT Paid Advertisement; 3 pages (Dec. 14, 2000).

* cited by examiner

CABLE WITH OFFSET FILLER

RELATED APPLICATIONS

The present utility application claims priority from the provisional application titled "CABLE WITH OFFSET FILLER" (Ser. No. 60/516,007) that was filed on Oct. 31, 2003, the contents of which are hereby incorporated herein in their entirety by reference. The present application is related to an application entitled "CABLE UTILIZING VARYING LAY LENGTH MECHANISMS TO MINIMIZE ALIEN CROSSTALK", filed on the same date as the present application.

BACKGROUND OF THE INVENTION

The present invention relates to cables made of twisted conductor pairs. More specifically, the present invention relates to twisted pair cables for high-speed data communications applications.

With the widespread and growing use of computers in communications applications, the ensuing volumes of data traffic have accentuated the need for communications networks to transmit the data at higher speeds. Moreover, advancements in technology have contributed to the design and deployment of high-speed communications devices that are capable of communicating the data at speeds greater than the speeds at which conventional data cables can propagate the data. Consequently, the data cables of typical communications networks, such as local area network (LAN) communities, limit the speed of data flow between communications devices.

In order to propagate data between the communications devices, many communications networks utilize conventional cables that include twisted conductor pairs (also referred to as "twisted pairs" or "pairs"). A typical twisted pair includes two insulated conductors twisted together along a longitudinal axis.

The twisted pair cables must meet specific standards of performance in order to efficiently and accurately transmit the data between the communication devices. If cables do not at least satisfy these standards, the integrity of their signals is jeopardized. Industry standards govern the physical dimensions, the performance, and the safety of the cables. For example, in the United States, the Electronic Industries Association/Telecommunications Industry Association (EIA/TIA) provides standards regarding the performance specifications of data cables. Several foreign countries have also adopted these or similar standards.

According to the adopted standards, the performance of twisted pair cables is evaluated using several parameters, including dimensional properties, interoperability, impedance, attenuation, and crosstalk. The standards require that the cables perform within certain parameter boundaries. For instance, a maximum average outer cable diameter of 0.250" is specified for many twisted pair cable types. The standards also require that the cables perform within certain electrical boundaries. The range of the parameter boundaries varies depending on the attributes of the signal to be propagated over the cable. In general, as the speed of a data signal increases, the signal becomes more sensitive to undesirable influences from the cable, such as the effects of impedance, attenuation, and crosstalk. Therefore, high-speed signals require better cable performance in order to maintain adequate signal integrity.

A discussion of impedance, attenuation, and crosstalk will help illustrate the limitations of conventional cables. The first listed parameter, impedance, is a unit of measure, expressed in Ohms, of the total opposition offered to the flow of an electrical signal. Resistance, capacitance, and inductance each contribute to the impedance of a cable's twisted pairs. Theoretically, the impedance of the twisted pair is directly proportional to the inductance from conductor effects and inversely proportional to the capacitance from insulator effects.

Impedance is also defined as the best "path" for data to traverse. For instance, if a signal is being transmitted at an impedance of 100 Ohms, it is important that the cabling over which it propagates also possess an impedance of 100 Ohms. Any deviation from this impedance match at any point along the cable will result in reflection of part of the transmitted signal back towards the transmission end of the cable, thereby degrading the transmitted signal. This degradation due to signal reflection is known as return loss.

Impedance deviations occur for many reasons. For example, the impedance of the twisted pair is influenced by the physical and electrical attributes of the twisted pair, including: the dielectric properties of the materials proximate to each conductor; the diameter of the conductor; the diameter of the insulation material around the conductor; the distance between the conductors; the relationships between the twisted pairs; the twisted pair lay lengths (distance to complete one twist cycle); the overall cable lay length; and the tightness of the jacket surrounding the twisted pairs.

Because the above-listed attributes of the twisted pair can easily vary over its length, the impedance of the twisted pair may deviate over the length of the pair. At any point where there is a change in the physical attributes of the twisted pair, a deviation in impedance occurs. For example, an impedance deviation will result from a simple increase in the distance between the conductors of the twisted pair. At the point of increased distance between the twisted pairs, the impedance will increase because impedance is known to be directly proportional to the distance between the conductors of the twisted pair.

Greater variations in impedance will result in worse signal degradation. Therefore, the allowable impedance variation over the length of a cable is typically standardized. In particular, the EIA/TIA standards for cable performance require that the impedance of a cable vary only within a limited range of values. Typically, these ranges have allowed for substantial variations in impedance because the integrity of traditional data signals has been maintained over these ranges. However, the same ranges of impedance variations jeopardize the integrity of high-speed signals because the undesirable effects of the impedance variations are accentuated when higher speed signals are transmitted. Therefore, accurate and efficient transmissions of high-speed signals, such as signals with aggregate speeds approaching and surpassing 10 gigabits per second, benefit from stricter control of the impedance variations over the length of a cable. In particular, post-manufacture manipulations of a cable, such as twisting the cable, should not introduce significant impedance mismatches into the cable.

The second listed parameter useful for evaluating cable performance is attenuation. Attenuation represents signal loss as an electrical signal propagates along a conductor length. A signal, if attenuated too much, becomes unrecognizable to a receiving device. To make sure this doesn't happen, standards committees have established limits on the amount of loss that is acceptable.

The attenuation of a signal depends on several factors, including: the dielectric constants of the materials surrounding the conductor; the impedance of the conductor; the frequency of the signal; the length of the conductor; and the diameter of the conductor. In order to help ensure acceptable attenuation levels, the adopted standards regulate some of these factors. For example, the EIA/TIA standards govern the allowable sizes of conductors for the twisted pairs.

The materials surrounding the conductors affect signal attenuation because materials with better dielectric properties (e.g., lower dielectric constants) tend to minimize signal loss. Accordingly, many conventional cables use materials such as polyethylene and fluorinated ethylene propylene (FEP) to insulate the conductors. These materials usually provide lower dielectric loss than other materials with higher dielectric constants, such as polyvinyl chloride (PVC). Further, some conventional cables have sought to reduce signal loss by maximizing the amount of air surrounding the twisted pairs. Because of its low dielectric constant (1.0), air is a good insulator against signal attenuation.

The material of the jacket also affects attenuation, especially when a cable does not contain internal shielding. Typical jacket materials used with conventional cables tend to have higher dielectric constants, which can contribute to greater signal loss. Consequently, many conventional cables use a "loose-tube" construction that helps distance the jacket from unshielded twisted pairs.

The third listed parameter that affects cable performance is crosstalk. Crosstalk represents signal degradation due to capacitive and inductive coupling between the twisted pairs. Each active twisted pair naturally produces electromagnetic fields (collectively "the fields" or "the interference fields") about its conductors. These fields are also known as electrical noise or interference because the fields can undesirably affect the signals being transmitted along other proximate conductors. The fields typically emanate outwardly from the source conductor over a finite distance. The strengths of the fields dissipate as the distances of the fields from the source conductor increase.

The interference fields produce a number of different types of crosstalk. Near-end crosstalk (NEXT) is a measure of signal coupling between the twisted pairs at positions near the transmitting end of the cable. At the other end of the cable, far-end crosstalk (FEXT) is a measure of signal coupling between the twisted pairs at a position near the receiving end of the cable. Powersum crosstalk represents a measure of signal coupling between all the sources of electrical noise within a cable entity that can potentially affect a signal, including multiple active twisted pairs. Alien crosstalk refers to a measure of signal coupling between the twisted pairs of different cables. In other words, a signal on a particular twisted pair of a first cable can be affected by alien crosstalk from the twisted pairs of a proximate second cable. Alien Power Sum Crosstalk (APSNEXT) represents a measure of signal coupling between all noise sources outside of a cable that can potentially affect a signal.

The physical characteristics of a cable's twisted pairs and their relationships to each other help determine the cable's ability to control the effects of crosstalk. More specifically, there are several factors known to influence crosstalk, including: the distance between the twisted pairs; the lay lengths of the twisted pairs; the types of materials used; the consistency of materials used; and the positioning of twisted pairs with dissimilar lay lengths in relation to each other. In regards to the distance between the twisted pairs of the cable, it is known that the effects of crosstalk within a cable decrease when the distance between twisted pairs is increased. Based on this knowledge, some conventional cables have sought to maximize the distance between each particular cable's twisted pairs.

In regards to the lay lengths of the twisted pairs, it is generally known that twisted pairs with similar lay lengths (i.e., parallel twisted pairs) are more susceptible to crosstalk than are non-parallel twisted pairs. This increased susceptibility to crosstalk exists because the interference fields produced by a first twisted pair are oriented in directions that readily influence other twisted pairs that are parallel to the first twisted pair. Based on this knowledge, many conventional cables have sought to reduce intra-cable crosstalk by utilizing non-parallel twisted pairs or by varying the lay lengths of the individual twisted pairs over their lengths.

It is also generally known that twisted pairs with long lay lengths (loose twist rates) are more prone to the effects of crosstalk than are twisted pairs with short lay lengths. Twisted pairs with shorter lay lengths orient their conductors at angles that are farther from parallel orientation than are the conductors of long lay length twisted pairs. The increased angular distance from a parallel orientation reduces the effects of crosstalk between the twisted pairs. Further, longer lay length twisted pairs cause more nesting to occur between pairs, creating a situation where distance between twisted pairs is reduced. This further degrades the ability of pairs to resist noise migration. Consequently, the long lay length twisted pairs are more susceptible to the effects of crosstalk, including alien crosstalk, than are the short lay length twisted pairs.

Based on this knowledge, some conventional cables have sought to reduce the effects of crosstalk between long lay length twisted pairs by positioning the long lay length pairs farthest apart within the jacket of the cable. For example, in a 4-pair cable, the two twisted pairs with the longer lay lengths would be positioned farthest apart (diagonally) from each other in order to maximize the distance between them.

With the above cable parameters in mind, many conventional cables have been designed to regulate the effects of impedance, attenuation, and crosstalk within individual cables by controlling some of the factors known to influence these performance parameters. Accordingly, conventional cables have attained levels of performance that are adequate only for the transmission of traditional data signals. However, with the deployment of emerging high-speed communications systems and devices, the shortcomings of conventional cables are quickly becoming apparent. The conventional cables are unable to accurately and efficiently propagate the high-speed data signals that can be used by the emerging communications devices. As mentioned above, the high-speed signals are more susceptible to signal degradation due to attenuation, impedance mismatches, and crosstalk, including alien crosstalk. Moreover, the high-speed signals naturally worsen the effects of crosstalk by producing stronger interference fields about the signal conductors.

Due to the strengthened interference fields generated at high data rates, the effects of alien crosstalk have become more significant to the transmission of high-speed data signals. While conventional cables could overlook the effects of alien crosstalk when transmitting traditional data signals, the techniques used to control crosstalk within the conventional cables do not provide adequate levels of isolation to protect from cable to cable alien crosstalk between the conductor pairs of high-speed signals. Moreover, some conventional cables have employed designs that actually work to increase the exposure of their twisted pairs to alien crosstalk. For example, typical star-filler cables often maintain the same cable diameter by reducing the thickness of their jackets and actually pushing their twisted pairs closer to the jacket surface, thereby worsening the effects of alien crosstalk by bringing the twisted pairs of proximate conventional cables closer together.

The effects of powersum crosstalk are also increased at higher data transmission rates. Traditional signals such as 10 megabits per second and 100 megabits per second Ethernet signals typically use only two twisted pairs for propagation over conventional cables. However, higher speed signals require increased bandwidth. Accordingly, high-speed signals, such as 1 gigabit per second and 10 gigabits per second Ethernet signals, are usually transmitted in full-duplex mode (2-way transmission over a twisted pair) over more than two twisted pairs, thereby increasing the number of sources of crosstalk. Consequently, conventional cables are not capable of overcoming the increased effects of powersum crosstalk that are produced by high-speed signals. More importantly, conventional cables cannot overcome the increases of cable to cable crosstalk (alien crosstalk), which crosstalk is increased substantially because all of the twisted pairs of adjacent cables are potentially active.

Similarly, other conventional techniques are ineffective when applied to high speed communications signals. For example, as mentioned above, some traditional data signals typically need only two twisted pairs for effective transmissions. In this situation, communications systems can usually predict the interference that one twisted pair's signal will inflict on the other twisted pair's signal. However, by using more twisted pairs for transmissions, complex high-speed data signals generate more sources of noise, the effects of which are less predictable. As a result, conventional methods used to cancel out the predictable effects of noise are no longer effective. In regards to alien crosstalk, predictability methods are especially ineffective because the signals of other cables are usually unknown or unpredictable. Moreover, trying to predict signals and their coupling effects on adjacent cables is impractical and difficult.

The increased effects of crosstalk due to high-speed signals pose serious problems to the integrity of the signals as they propagate along conventional cables. Specifically, the high-speed signals will be unacceptably attenuated and otherwise degraded by the effects of alien crosstalk because conventional cables traditionally focus on controlling intra-cable crosstalk and are not designed to adequately combat the effects of alien crosstalk produced by high-speed signal transmissions.

Conventional cables have used traditional techniques to reduce intra-cable crosstalk between twisted pairs. However, conventional cables have not applied those techniques to the alien crosstalk between adjacent cables. For one, conventional cables have been able to comply with specifications for slower traditional data signals without having to be concerned with controlling alien crosstalk. Further, suppressing alien crosstalk is more difficult than controlling intra-cable cross-talk because, unlike intra-cable crosstalk from known sources, alien crosstalk cannot be precisely measured or predicted. Alien crosstalk is difficult to measure because it typically comes from unknown sources at unpredictable intervals.

As a result, conventional cabling techniques have not been successfully used to control alien crosstalk. Moreover, many traditional techniques cannot be easily used to control alien crosstalk. For example, digital signal processing has been used to cancel out or compensate for effects of intra-cable crosstalk. However, because alien crosstalk is difficult to measure or predict, known digital signal processing techniques cannot be cost effectively applied. Thus, there exists an inability in conventional cables to control alien crosstalk.

In short, conventional cables cannot effectively and accurately transmit high-speed data signals. Specifically, the conventional cables do not provide adequate levels of protection and isolation from impedance mismatches, attenuation, and crosstalk. For example, the Institute of Electrical and Electronics Engineers (IEEE) estimates that in order to effectively transmit 10 Gigabit signals at 100 megahertz (MHz), a cable must provide at least 60 dB of isolation against noise sources outside of the cable, such as adjacent cables. However, conventional cables of twisted conductor pairs typically provide isolations well short of the 60 dB needed at a signal frequency of 100 MHz, usually around 32 dB. The cables radiate about nine times more noise than is specified for 10 Gigabit transmissions over a 100 meter cabling media. Consequently, conventional twisted pair cables cannot transmit the high-speed communications signals accurately or efficiently.

Although other types of cables have achieved over 60 dB of isolation at 100 MHz, these types of cables have shortcomings that make their use undesirable in many communications systems, such as LAN communities. A shielded twisted pair cable or a fiber optic cable may achieve adequate levels of isolation for high-speed signals, but these types of cables cost considerably more than unshielded twisted pairs. Unshielded systems typically enjoy significant cost savings, which savings increase the desirability of unshielded systems as a transmitting medium. Moreover, conventional unshielded twisted pair cables are already well-established in a substantial number of existing communications systems. It is desirable for unshielded twisted pair cables to communicate high-speed communication signals efficiently and accurately. Specifically, it is desirable for unshielded twisted pair cables to achieve performance parameters adequate for maintaining the integrity of high-speed data signals during efficient transmission over the cables.

SUMMARY OF THE INVENTION

The present invention relates to cables made of twisted conductor pairs. More specifically, the present invention relates to twisted pair communication cables for high-speed data communications applications. A twisted pair including at least two conductors extends along a generally longitudinal axis, with an insulation surrounding each of the conductors. The conductors are twisted generally longitudinally along the axis. A cable includes at least two twisted pairs and a filler. At least two of the cables are positioned along generally parallel axes for at least a predefined distance. The cables are configured to efficiently and accurately propagate high-speed data signals by, among other functions, limiting at least a subset of the following: impedance deviations, signal attenuation, and alien crosstalk along the predefined distance.

BRIEF DESCRIPTION OF THE DRAWINGS

Certain embodiments of present cables will now be described, by way of examples, with reference to the accompanying drawings, in which.

DETAILED DESCRIPTION

I. Introduction of Elements and Definitions

The present invention relates in general to cables configured to accurately and efficiently propagate high-speed data signals, such as data signals approaching and surpassing data rates of 10 gigabits per second. Specifically, the cables can be configured to efficiently propagate the high-speed data signals while maintaining the integrity of the data signals.

A. Cabled Group View

Figure 1:
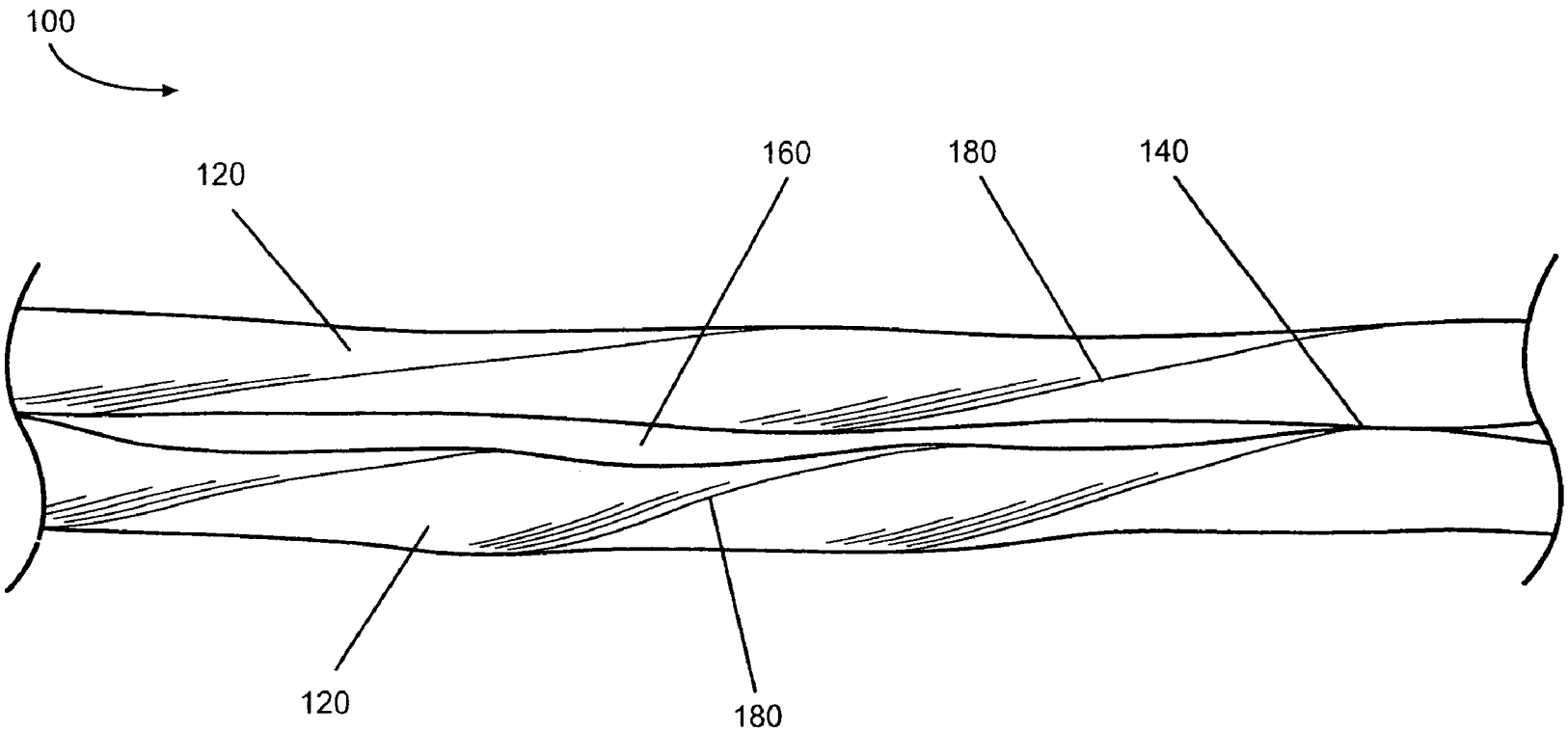
FIG. 1 shows a perspective view of a cabled group including two cables positioned longitudinally adjacent to each other.

Referring now to the drawings, FIG. 1 shows a perspective view of a cabled group, shown generally at 100, that includes two cables 120 positioned generally along parallel axes, or longitudinally adjacent to each other. The cables 120 are configured to create points of contact 140 and air pockets 160 between the cables 120. As shown in FIG. 1, the cables 120 can be independently twisted about their own longitudinal axes. The cables 120 may be rotated at dissimilar twist rates. Further, the twist rate of each cable 120 may vary over the longitudinal length of the cable 120. As mentioned above, the twist rate can be measured by the distance of a complete twist cycle, which is referred to as lay length.

The cables 120 include elevated points along their outer edges, referred to as ridges 180. The twisting of the cables 120 causes the ridges 180 to helically rotate along the outer edge of each cable 120, resulting in the formation of the air pockets 160 and the points of contact 140 at different locations along the longitudinally extending cables 120. The ridges 180 help maximize the distance between the cables 120. Specifically, the ridges 180 of the twisted cables 120 help prevent the cables 120 from nesting together. The cables 120 touch only at their ridges, which ridges 180 help increase the distance between the twisted conductor pairs 240 (not shown; see FIG. 2) of the cables 120. At non-contact points along the cables 120, the air pockets 160 are formed between the cables 120. Like the ridges 180, the air pockets 160 help increase the distance between the twisted conductor pairs 240 of the cables 120.

By maximizing the distance, in part through twist rotations, between the sheathed cables 120, the interference between the cables 120, especially the effects of alien crosstalk, is reduced. As mentioned, capacitive and inductive interference fields are known to emanate from the high-speed data signals being propagated along the cables 120. The strength of the fields increases with an increase in the speed of the data transmissions. Therefore, the cables 120 minimize the effects of the interference fields by increasing distances between adjacent cables 120. For example, the increased distances between the cables 120 help reduce alien crosstalk between the cables 120 because the effects of alien crosstalk are inversely proportional to distance.

Although FIG. 1 shows two cables 120, the cabled group 100 may include any number of cables 120. The cabled group 100 may include a single cable 120. In some embodiments, two cables 120 are positioned along generally parallel longitudinal axes over at least a predefined distance. In other embodiments, more than two cables 120 are positioned along generally parallel longitudinal axes over at least the predefined distance. In some embodiments, the predefined distance is a ten meter length. In some embodiments, the adjacent cables 120 are independently twisted. In other embodiments, the cables 120 are twisted together.

The cabled group 100 can be used in a wide variety of communications applications. The cabled group 100 may be configured for use in communications networks, such as a local area network (LAN) community. In some embodiments, the cabled group 100 is configured for use as a horizontal network cable or a backbone cable in a network community. The configuration of the cables 120, including their individual twist rates, will be further explained below.

B. Cable View

Figure 2:
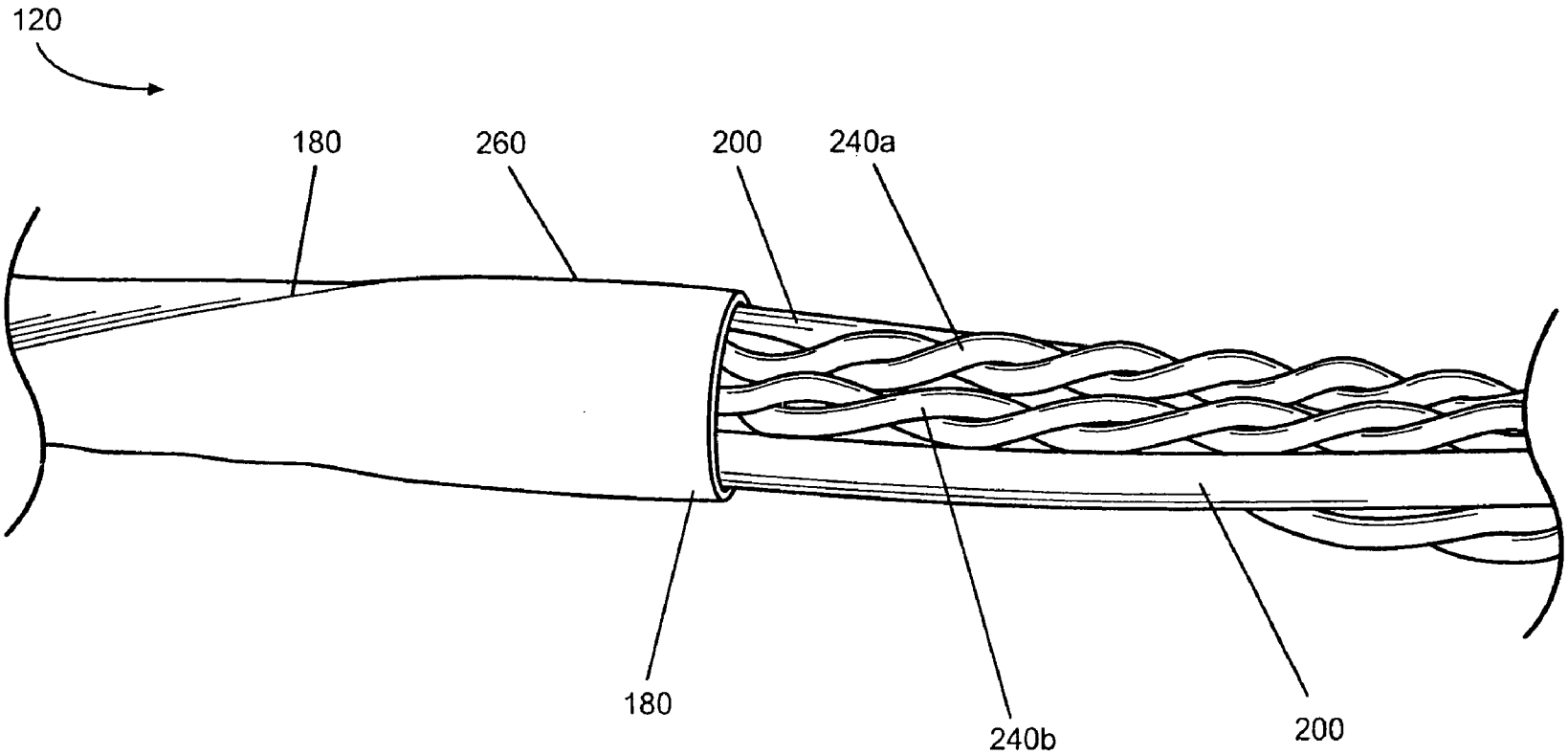
FIG. 2 shows a perspective view of an embodiment of a cable, with a cutaway section exposed.

FIG. 2 shows a perspective view of an embodiment of the cable 120, with a cutaway section exposed. The cable 120 includes a filler 200 configured to separate a number of the twisted conductor pairs 240 (also referred to as "the twisted pairs 240," "the pairs 240," and "the cabled embodiments 240"), including twisted pair 240*a* and twisted pair 240*b*. The filler 200 extends generally along a longitudinal axis, such as the longitudinal axis of one of the twisted pairs 240. A jacket 260 surrounds the filler 200 and the twisted pairs 240.

The twisted pairs 240 can be independently and helically twisted about individual longitudinal axes. The twisted pairs 240 may be distinguished from each other by being twisted at generally dissimilar twist rates, i.e., different lay lengths, over a specific longitudinal distance. In FIG. 2, the twisted pair 240*a* is twisted more tightly than the twisted pair 240*b* (i.e., the twisted pair 240*a* has a shorter lay length than the twisted pair 240*b*). Thus, the twisted pair 240*a* can be said to have a short lay length, and the twisted pair 240*b* to have a long lay length. By having different lay lengths, the twisted pair 240*a* and the twisted pair 240*b* minimize the number of parallel crossover points that are known to readily carry crosstalk noise.

As shown in FIG. 2, the cable 120 includes the helically rotating ridge 180 that rotates as the cable 120 is twisted about a longitudinal axis. The cable 120 can be twisted about the longitudinal axis at various cable lay lengths. It should be noted that the lay length of the cable 120 affects the individual lay lengths of the twisted pairs 240. When the lay length of the cable 120 is shortened (tighter twist rate), the individual lay lengths of the twisted pairs 240 are shortened, also. The cable 120 can be configured to beneficially affect the lay lengths of the twisted pairs 240, which configurations will be further explained in relation to the cable 120 lay length limitations.

FIG. 2 also shows the filler 200 helically twisted about a longitudinal axis. The filler 200 can be twisted at different or variable twist rates along a predefined distance. Accordingly, the filler 200 is configured to be flexible and rigid—flexible for twisting at different twist rates and rigid for maintaining the different twist rates. The filler 200 should be twisted enough, i.e., have a small enough lay length, to form the air pockets 160 between adjacent cables 120. By way of example only, in some embodiments, the filler 200 is twisted at a lay length of no more than approximately one-hundred times the lay length of one of the twisted pairs 240 in order to form the air pockets 160. The filler 200 will be further discussed in relation to FIG. 4A.

The filler 200 and the jacket 260 can include any material that meets industry standards. The filler can comprise but is not limited to any of the following: polyfluoroalkoxy, TFE/Perfluoromethyl-vinylether, ethylene chlorotrifluoroethylene, polyvinyl chloride (PVC), a lead-free flame retardant PVC, fluorinated ethylene propylene (FEP), fluorinated perfluoroethylene polypropylene, a type of fluoropolymer, flame retardant polypropylene, and other thermoplastic materials. Similarly, the jacket 260 may comprise any material that meets industry standards, including any of the materials listed above.

The cable 120 can be configured to satisfy industry standards, such as safety, electrical, and dimensional standards. In some embodiments, the cable 120 comprises a horizontal or backbone network cable 120. In such embodiments, the cable 120 can be configured to satisfy industry safety standards for horizontal network cables 120. In some embodiment, the cable 120 is plenum rated. In some embodiments, the cable 120 is riser rated. In some embodiments, the cable 120 is unshielded. The advantages generated by the configurations of the cable 120 are further explained below in reference to FIG. 4A.

C. Twisted Pair View

Figure 3:
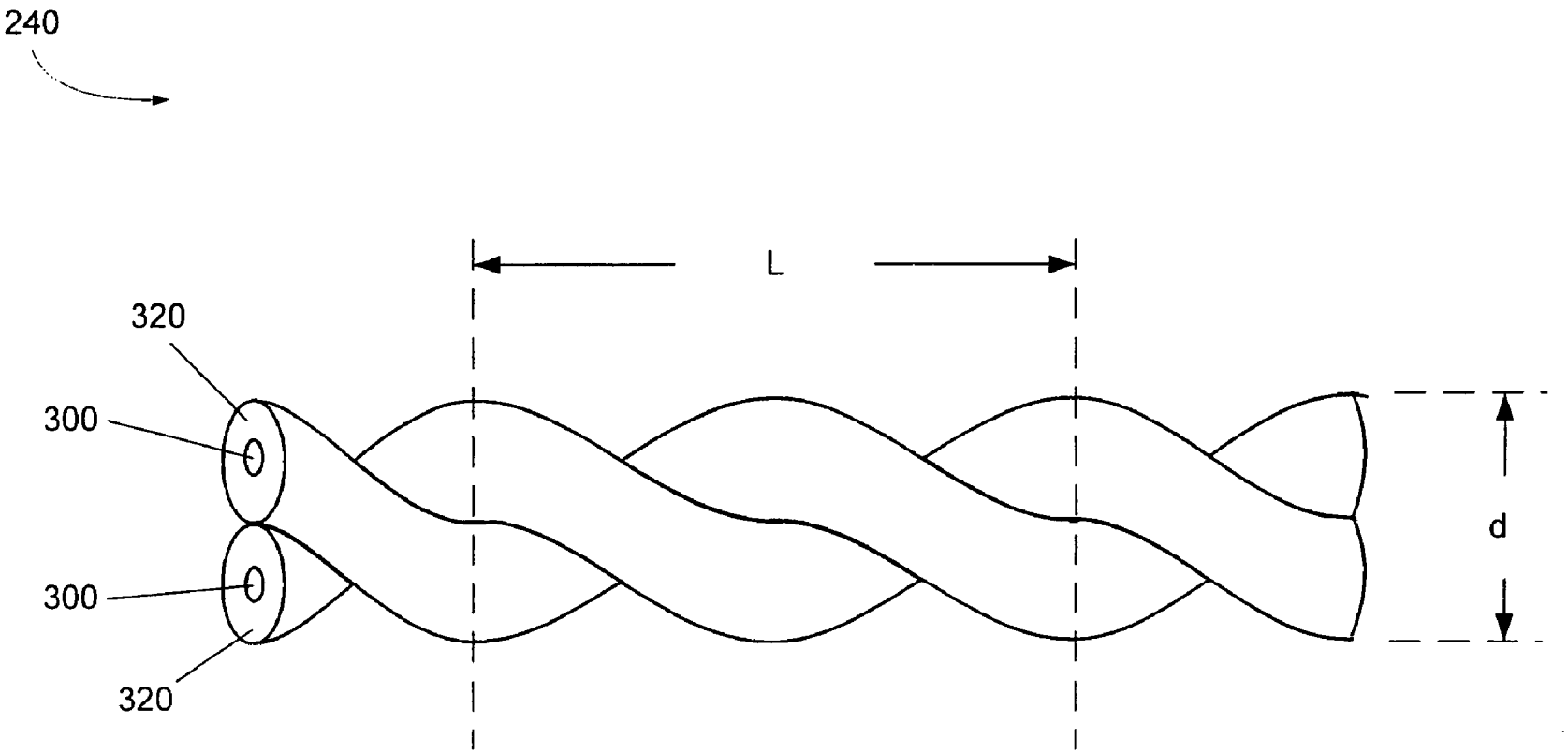
FIG. 3 is a perspective view of a twisted pair.

FIG. 3 is a perspective view of one of the twisted pairs 240. As shown in FIG. 3, the cabled embodiment 240 includes two conductors 300 individually insulated by insulators 320 (also referred to as "insulation 320"). One conductor 300 and its surrounding insulator 320 are helically twisted together with the other conductor 300 and insulator 320 down a longitudinal axis. FIG. 3 further indicates the diameter (d) and the lay length (L) of the twisted pair 240. In some embodiments, the twisted pair 240 is shielded.

The twisted pair 240 can be twisted at various lay lengths. In some embodiments, the twisted pair's 240 conductors 300 are twisted generally longitudinally down said axis at a specific lay length (L). In some embodiments, the lay length (L) of the twisted pair 240 varies over a portion or all of the longitudinal distance of the twisted pair 240, which distance may be a predefined distance or length. By way of example only, in some embodiments, the predefined distance is approximately ten meters to allow enough length for correct propagation of signals as a consequence of their wavelengths.

The twisted pair 240 should conform to the industry standards, including standards governing the size of the twisted pair 240. Accordingly, the conductors 300 and insulators 320 are configured to have good physical and electrical characteristics that at least satisfy the industry standards. It is known that a balanced twisted pair 240 helps to cancel out the interference fields that are generated in and about its active conductors 300. Accordingly, the sizes of the conductors 300 and the insulators 320 should be configured to promote balance between the conductors 300.

Accordingly, the diameter of each of the conductors 300 and the diameter of each of the insulators 320 are sized to promote balance between each single (one conductor 300 and one insulator) of the twisted pair 240. The dimensions of the cable 120 components, such as the conductors 300 and the insulators 320, should comply with industry standards. In some embodiments, the dimensions, or size, of the cables 120 and their components comply with industry dimensional standards for RJ-45 cables and connectors, such as RJ-45 jacks and plugs. In some embodiments, the industry dimensional standards include standards for Category 5, Category 5*e*, and/or Category 6 cables and connectors. In some embodiments, the size of the conductors 300 is between #22 American Wire Gage (AWG) and #26 AWG.

Each of the conductors 300 of the twisted pair 240 can comprise any conductive material that meets industry standards, including but not limited to copper conductors 300. The insulator 320 may comprise but is not limited to thermoplastics, fluoropolymer materials, flame retardant polyethylene (FRPE), flame retardant polypropylene (FRPP), high density polyethylene (HDPE), polypropylene (PP), perfluoralkoxy (PFA), fluorinated ethylene propylene (FEP) in solid or foamed form, foamed ethylene-chlorotrifluoroethylene (ECTFE), and the like.

D. Cross-sectional View of Cable

Figure 4A:
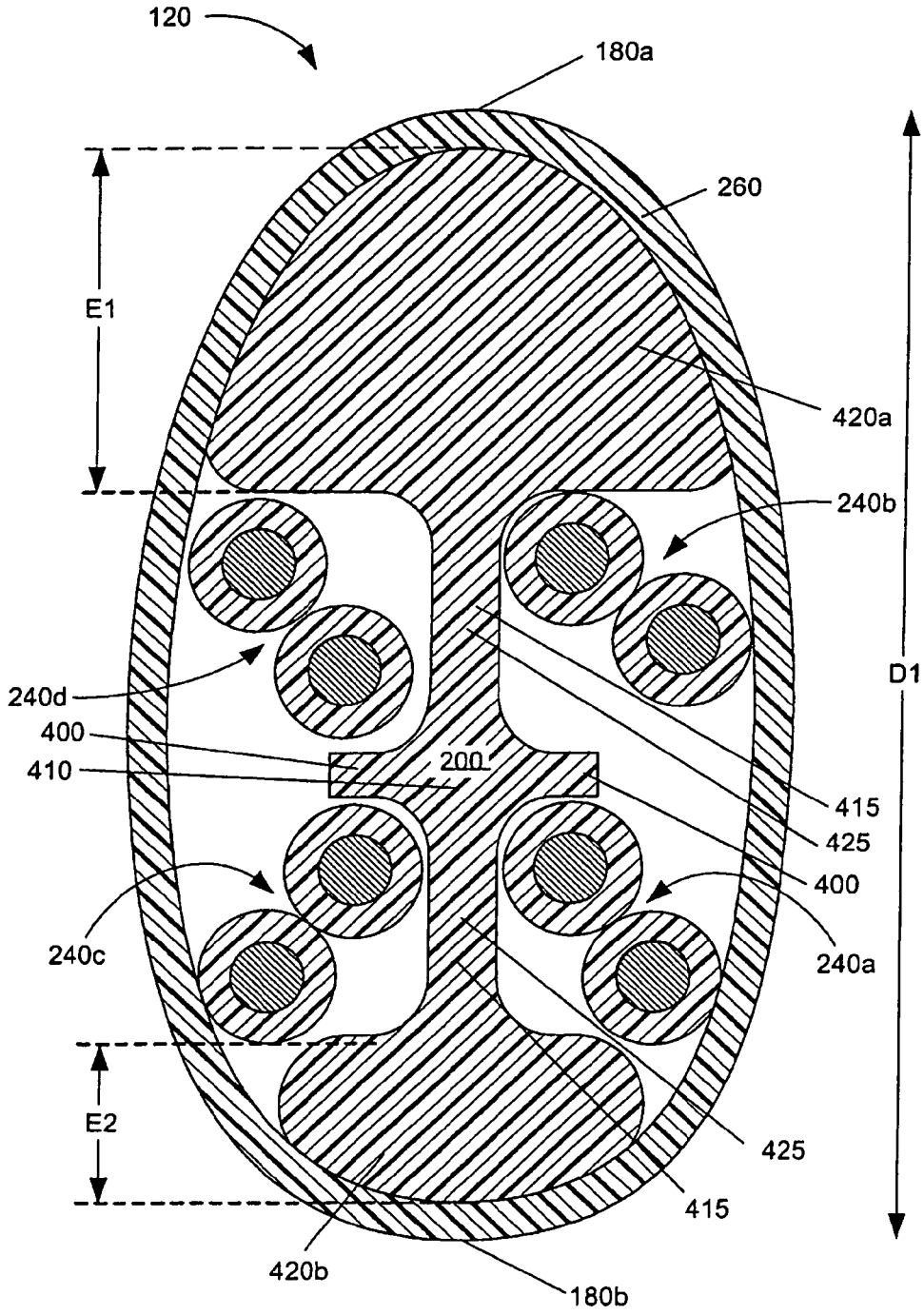
FIG. 4A shows an enlarged cross-sectional view of a cable according to a first embodiment of the invention.

FIG. 4A shows an enlarged cross-sectional view of the cable 120 according to a first embodiment of the invention. As shown in FIG. 4A, the jacket 260 surrounds the filler 200 and the twisted pairs 240*a*, 240*b*, 240*c*, 240*d* (collectively "the twisted pairs 240") to form the cable 120. The twisted pairs 240*a*, 240*b*, 240*c*, 240*d* can be distinguished by having dissimilar lay lengths. While the twisted pairs 240*a*, 240*b*, 240*c*, 240*d* may have dissimilar lay lengths, they should be twisted in the same direction in order to minimize impedance mismatches, either all twisted pairs 240 having a right-hand twist or a left-hand twist. The lay lengths of the twisted pairs 240*b*, 240*d* are preferably similar, and the lay lengths of the twisted pairs 240*a*, 240*c* are preferably similar. In some embodiments, the lay lengths of the twisted pairs 240*a*, 240*c* are less than the lay lengths of the twisted pairs 240*b*, 240*d*. In such embodiments, the twisted pairs 240*a*, 240*c* can be referred to as the shorter lay length twisted pairs 240*a*, 240*c*, and the twisted pairs 240*b*, 240*d* can be referred to as the longer lay length twisted pairs 240*b*, 240*d*. The twisted pairs 240 are shown selectively positioned in the cable 120 to minimize alien crosstalk. The selective positioning of the twisted pairs 240 will be further discussed below.

The filler 200 can be positioned along the twisted pairs 240. The filler 200 may form regions, such as quadrant regions, each region being configured to selectively receive and house a particular twisted pair 240. The regions form longitudinal grooves along the length of the filler 200, which grooves can house the twisted pairs 240. As shown in FIG. 4A, the filler 200 can include a core 410 and a number of filler dividers 400 that extend radially outward from the core 410. In some preferred embodiments, the core 410 of the filler 200 is positioned at a point approximately central to the twisted pairs 240. The filler 200 further includes a number of legs 415 extending radially outward from the core 410. The twisted pairs 240 can be positioned adjacent to the legs 410 and/or the filler dividers 400. In some preferred embodiments, the length of each leg 415 is at least generally equal to approximately the diameter of the twisted pair 240 selectively positioned adjacent to the leg 415.

Figure 5A:
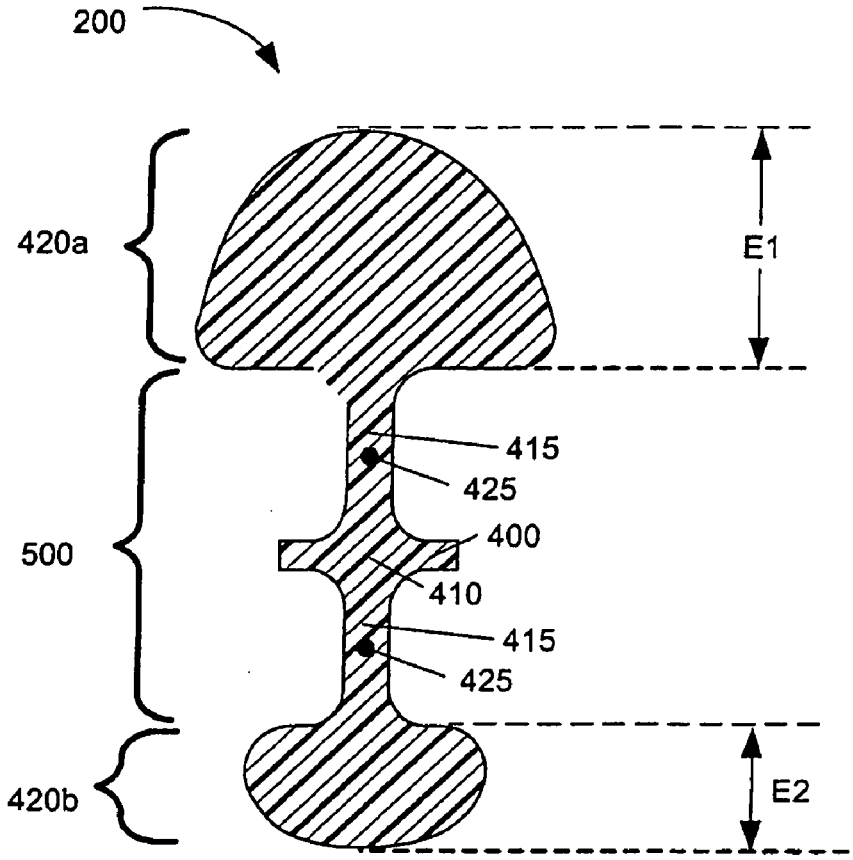
FIG. 5A shows an enlarged cross-sectional view of a filler according to the first embodiment of the invention.

The legs 415 and the core 410 of the filler 200 can be referred to as a base portion 500 of the filler 200. FIG. 5A is an enlarged cross-sectional view of the filler 200 according to the first embodiment. In FIG. 5A, the filler 200 includes a base portion 500 that comprises the legs 415, the dividers 400, and the core of the filler 200. In some embodiments, the base portion 500 includes any part of the filler 200 that does not extend beyond the diameter of the twisted pairs 240, while the twisted pairs 240 are selectively housed by the regions formed by the filler 200. Accordingly, the twisted pairs 240 should be positioned adjacent to the legs 415 of the base portion 500 of the filler 200.

Referring back to FIG. 4A, the filler 200 can include a number of filler extensions 420*a*, 420*b* (collectively "the filler extensions 420") extending radially outward in different directions from the base portion 500, and specifically extending from the legs 415 of the base portion 500. The extension 420 to the leg 415 may extend radially outward away from the base portion 500 at least a predefined extent. As shown in FIG. 4A and FIG. 5A, the length of the predefined extent may be different for each extension 420*a*, 420*b*. The predefined extent of the extension 420*a* is a length E1, while the predefined extent of the extension 420*b* is a length E2. In some embodiments, the predefined extent of the extension 420 is at least approximately one-quarter the diameter of one of the twisted pairs 240 housed by the filler 200. By having a predefined extent of at least approximately this distance, the filler extension 420 offsets the filler 200, thereby helping to decrease alien crosstalk between adjacent cables 120 by maximizing the distance between the respective twisted pairs 240 of the adjacent cables 120.

FIG. 4A shows a reference point 425 located at a position on each leg 415 of the filler 200. The reference point 425 is useful for measuring the distance between adjacently positioned cables 120. The reference point 425 is located at a certain length away from the core 410 of the filler 200. In FIG. 4A and other preferred embodiments, the reference point 425 is located at approximately the midpoint of each leg 415. In other words, some embodiments include the reference point 425 at a position that is distanced from the core 410 by approximately one-half the length of the diameter of one of the housed twisted pairs 240.

The filler 200 may be shaped to configure the regions to fittingly house the twisted pairs 240. For example, the filler 200 can include curved shapes and edges that generally fit to the shape of the twisted pairs 240. Accordingly, the twisted pairs 240 are able to nest snugly against the filler 200 and within the regions. For example, FIG. 4A shows that the filler 200 may include concave curves configured to house the twisted pairs 240. By tightly housing the twisted pairs 240, the filler 200 helps to generally fix the twisted pairs 240 in position with respect to one another, thereby minimizing impedance deviations and capacitive unbalance over the length of the cable 120, which benefit will be further discussed below.

The filler 200 can be offset. Specifically, the filler extension 420 may be configured to offset the filler 200. For example, in FIG. 4A, each of the filler extensions 420 extends beyond an outer edge of the cross-sectional area of at least one of the twisted pairs 240, which length is referred to as the predefined extent. In other words, the extensions 420 extend away from the base portion 500. The filler extension 420*a* extends beyond the cross-sectional area of the twisted pair 240*b* and the twisted pair 240*d* by the distance (E1). In similar fashion, the filler extension 420*b* extends beyond the cross-sectional area of the twisted pair 240*a* and the twisted pair 240*c* by the distance (E2). Accordingly, the filler extensions 420 may be different lengths, e.g., the extension length (E1) is greater than the extension length (E2). As a result, the filler extension 420*a* has a cross-sectional area that is larger than the cross-sectional area of the filler extension 420*b*.

The offset filler 200 helps minimize alien crosstalk. In addition, alien crosstalk between adjacent cables 120 can be further minimized by offsetting the filler 200 by at least a minimum amount. Accordingly, the extension lengths of symmetrically positioned filler extensions 420 should be different to offset the filler 200. The filler 200 should be offset enough to help form the air pockets 160 between helically twisted adjacent cables 120. The air pockets 160 should be large enough to help maintain at least an average minimum distance between adjacent cables 120 over at least a predefined length of the adjacent cables 120. In addition, the offset fillers 200 of adjacent cables 120 can function to distance the longer lay length twisted pairs 240*b*, 240*d* of one of the cables 120 farther away from outside adjacent noise sources, such as close proximity cabling embodiments, than are the shorter lay length twisted pairs 240*a*, 240*c*. For example, in some embodiments, the extension length (E1) is approximately two times the extension length (E2). By way of example only, in some embodiments, the extension length (E1) is approximately 0.04 inches (1.016 mm), and the extension length (E2) is approximately 0.02 inches (0.508 mm). Subsequently, the longer lay length pairs 240*b*, 240*d* could be placed next to the longest extension 420*a* to maximize the distance between the long lay length pairs 240*b*, 240*d* and any outside adjacent noise sources.

Not only should symmetrically positioned filler extensions 420 be of different lengths to offset the filler 200, the filler extensions 420 of the cable 120 preferably extend at least a minimum extension length. In particular, the filler extensions 420 should extend beyond a cross-sectional area of the twisted pairs 240 enough to help form the air pockets 160 between adjacent cables 120 that are helically twisted, which air pockets 160 can help maintain at least an approximate minimum average distance between the adjacent cables 120 over at least the predefined length. For example, in some preferred embodiments, at least one of the filler extensions 420 extends beyond the outer edge of a cross-sectional area of at least one of the twisted pairs 240 by at least one-quarter of the diameter (d) of the same twisted pair 240, while the twisted pair 240 is housed adjacent to the filler 200. In other preferred embodiments, an air pocket 160 is formed having a maximum extent of at least 0.1 times the diameter of a diameter of one of the cables 120. The effects of the extension lengths (E1, E2) and the offset filler 200 on alien crosstalk will be further discussed below.

The cross-sectional area of the filler 200 can be enlarged to help improve the performance of the cable 200. Specifically, the filler extension 420 of the cable 120 can be enlarged, e.g., radiused radially outward toward the jacket 260, to help generally fix the twisted pairs 240 in position with respect to one another. As shown in FIG. 4A, the filler extensions 420*a*, 420*b* can be expanded to comprise different cross-sectional areas. Specifically, by enlarging the cross-sectional areas of the filler 200, the undesirable effects of impedance mismatch and capacitive unbalance are minimized, thereby making the cable 120 capable of performing at high data rates while maintaining signal integrity. These benefits will be further discussed below.

Further, the outer edges of the filler extensions 420 can be curved to support the jacket 260 while allowing the jacket 260 to tightly fit over the filler extensions 420. The curvature of the outer edges of the filler extensions 420 helps to improve the performance of the cable 120 by minimizing impedance mismatches and capacitive unbalance. Specifically, by fitting snugly against the jacket 260, the filler extensions 420 reduce the amount of air in the cable 120 and generally fix the components of the cable 120 in position, including the positions of the twisted pairs 240 with respect to one another. In some preferred embodiments, the jacket 260 is compression fitted over the filler 200 and the twisted pairs 240. The benefit of these attributes will be further discussed below.

The filler extensions 420 form the ridges 180 along the outer edge of the cable 120. The ridges 180 are elevated at different heights according to the lengths of the filler extensions 420. As shown in FIG. 4A, the ridge 180*a* is more elevated than the ridge 180*b*. This helps to offset the cables 120 in order to reduce alien crosstalk between adjacent cables 120, which characteristic will be further discussed below.

A measure of the greatest diameter (D1) of the cable 120 is also shown in FIG. 4A. For the cable 120 shown in FIG. 4A, the diameter (D1) is the distance between the ridge 180*a* and the ridge 180*b*. As mentioned above, the cable 120 can be a particular size or diameter such that it complies with certain industry standards. For example, the cable 120 may be a size that complies with Category 5, Category 5e, and/or Category 6 unshielded cables. By way of example only, in some embodiments, the diameter (D1) of the cable 120 is no more than 0.25 inches (6.35 mm).

By complying with existing dimensional standards for unshielded twisted pair cables, the cable 120 can easily be used to replace existing cables. For example, the cable 120 can readily be substituted for a category 6 unshielded cable in a network of communication devices, thereby helping to increase the available data propagation speeds between the devices. Further, the cable 120 can be readily connectable with existing connector devices and schemes. Thus, the cable 120 can help improve the communications speeds between devices of existing networks.

Although FIG. 4A shows two filler extensions 420, other embodiments can include various numbers and configurations of filler extensions 420. Any number of filler extensions 420 may be used to increase the distances between cables 120 positioned proximate to one another. Similarly, filler extensions 420 of different or similar lengths can be used. The distance provided between the adjacent cables 120 by the filler extensions 420 reduces the effects of interference by increasing the distance between the cables 120. In some embodiments, the filler 200 is offset to facilitate the distancing of the cables 120 as the cables 120 are individually rotated. The offset filler 200 then helps isolate a particular cable's 120 twisted pairs 240 from the alien crosstalk generated by another cable's 120 twisted pairs 240.

Figure 4B:
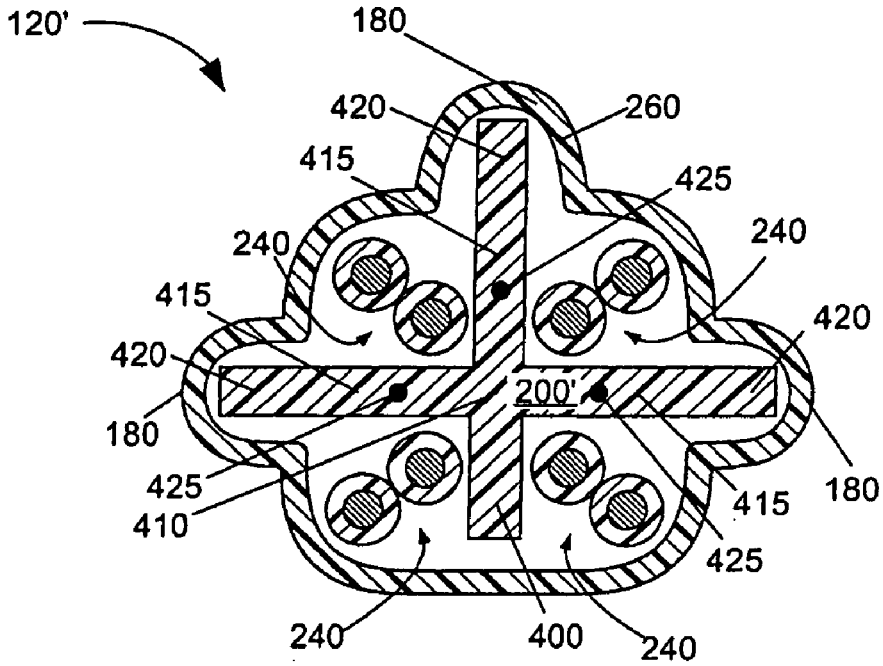
FIG. 4B shows an enlarged cross-sectional view of a cable according to a second embodiment.
Figure 4C:
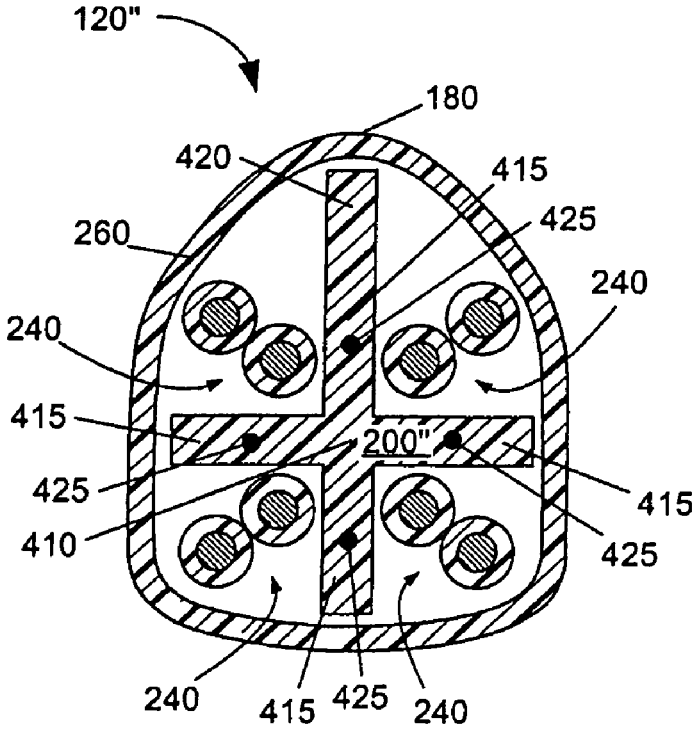
FIG. 4C shows an enlarged cross-sectional view of a cable according to a third embodiment.

To illustrate examples of other embodiments of the cable 120, FIGS. 4B–4C show various different embodiments of the cable 120. FIG. 4B shows an enlarged cross-sectional view of a cable 120' according to a second embodiment . . . The cable 120' shown in FIG. 4B includes a filler 200' that includes three legs 415 and three filler extensions 420 extending away from the legs 415 and beyond the cross-sectional areas of the twisted pairs 240. Each of the legs 415 includes the reference point 415.The filler 200' can function in any of the ways discussed above in relation to the filler 200, including helping to distance adjacently positioned cables 120' from one another.

Similarly, FIG. 4C shows an enlarged cross-sectional view of a cable 120" according to a third embodiment, which cable 120" includes a filler 200" with a number of legs 415 and one filler extension 420 extending away from one of the legs 415 and beyond the cross-sectional area of at least one of the twisted pairs 240. The legs 415 include the reference points 425. In other embodiments, the legs 415 shown in FIG. 4C can be filler dividers 400. The filler 200" can also function in any of the ways that the filler 200 can function.

Figure 5B:
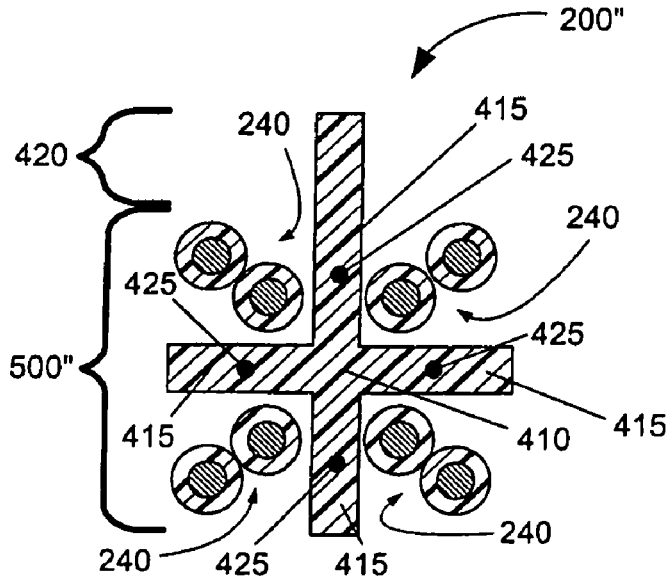
FIG. 5B shows an enlarged cross-sectional view of a filler according to the third embodiment.

FIG. 5B shows an enlarged cross-sectional view of the filler 200" according to the third embodiment. As shown in FIG. 5B, the filler 200" can include a base portion 500" having a number of legs 415 and the extension 420 extending away from the base portion 500" and, more specifically, away from one of the legs 415 of the base portion 500". FIG. 5B shows four twisted pairs 240 positioned adjacent to the base portion 500". The extension 420 extends away from the base portion 500" by at least approximately the predefined extent. In the embodiment shown in FIG. 5B, the filler 200" includes four legs 415 with the twisted pairs 240 adjacent to the legs 415. Each of the legs 415 of the base portion 500" includes the reference point 425.

Figure 4D:
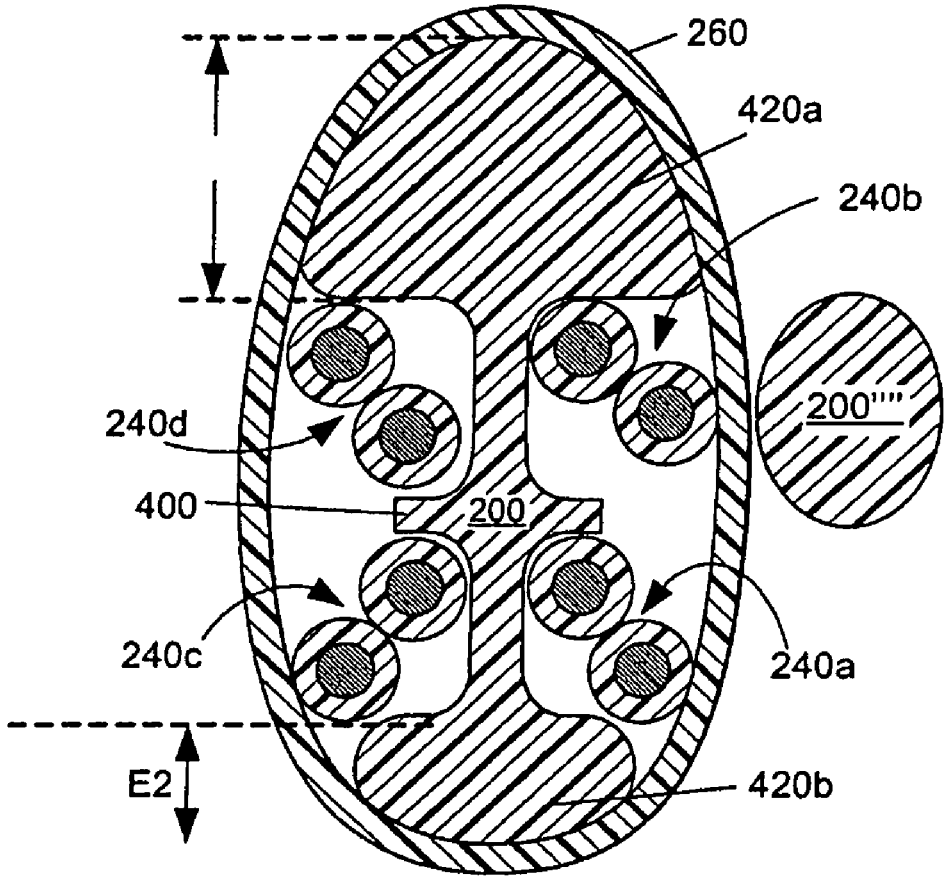
FIG. 4D shows an enlarged cross-sectional view of a cable and a filler according to the embodiment of FIG. 4A in combination with a second filler.

The filler 200 can be configured in other ways for distancing adjacently positioned cables 120. For example, FIG. 4D shows an enlarged cross-sectional view of the cable 120 and the filler 200 according to the embodiment of FIG. 4A in combination with a different filler 200"" positioned along the cable 120. The filler 200"" can be helically twisted about along the cable 120, or any component of the cable 120. By being positioned along the cable 120, the filler 200"" can be positioned in between adjacently placed cables 120 and maintain a distance between them. As the filler 200"" helically twists about the cable 120, it prevents adjacent cables 120 from nesting together. The filler 200"" may be positioned along any embodiment of the cable 120. In some embodiments, the filler 200"" is positioned along the twisted pairs 240.

The configuration of the cables 120, such as the embodiments shown in FIGS. 4A–4D, are able to adequately maintain the integrity of the high-speed data signals being propagated over the cables 120. The cables 120 are capable of such performance due to a number of features, including but not limited to the following. First, the cable configurations help to increase the distance between the twisted pairs 240 of adjacent cables 120, thereby reducing the effects of alien crosstalk. Second, the cables 120 can be configured to increase the distance between the radiating sources that are most prone to alien crosstalk, e.g., the longer lay length twisted pairs 240*b*, 240*d*. Third, the cables 120 may be configured to help reduce the capacitive coupling between the twisted pairs 240 by improving the consistency of the dielectric properties of the materials surrounding the twisted pairs 240. Fourth, the cable 120 can be configured to minimize the variations in impedance over its length by maintaining the physical attributes of the cable 120 components, even when the cable 120 is twisted, thereby reducing signal attenuation. Fifth, the cables 120 can be configured to reduce the number of instances of parallel twisted pairs 240 along longitudinally adjacent cables 120, thus minimizing the occurrences of positions that are prone to alien crosstalk. These features and advantages of the cables 120 will now be discussed in further detail.

E. Distance Maximization

The cables 120 can be configured to minimize the degradation of propagating high-speed signals by maximizing the distance between the twisted pairs 240 of adjacent cables 120. Specifically, the distancing of the cables 120 reduces the effects of alien crosstalk. As mentioned above, the magnitudes of the fields that cause alien crosstalk weaken with distance.

The adjacent cables 120 can be individually and helically twisted along generally parallel axes as shown in FIG. 1 such that the points of contact 140 and the air pockets 160 shown in FIG. 1 are formed at various positions along the adjacent cables 120. The cables 120 may be twisted so that the ridges 180 form the points of contact 140 between the cables 120, as discussed in relation to FIG. 1. Accordingly, at various positions along the longitudinal axes, the adjacent cables 120 may touch at their ridges 180. At non-contact points, the adjacent cables 120 can be separated by the air pockets 160. The cables 120 may be configured to increase the distance between their twisted pairs 240 at both the points of contact 140and the non-contact points, thereby reducing alien crosstalk. In addition, by using a randomized helical twisting for different adjacent cables 120, the distance between the adjacent cables 120 is maximized by discouraging nesting of the adjacent cables 120 in relation to one another.

Further, the cables 120 can be configured to maximally distance their longer lay length twisted pairs 240*b*, 240*d*. As mentioned above, the longer lay length twisted pairs 240*b*, 240*d* are more prone to alien crosstalk than are the shorter lay length twisted pairs 240*a*, 240*c*. Accordingly, the cables 120 may selectively position the longer lay length twisted pairs 240*b*, 240*d* proximate to the largest filler extension 420*a* of each cable 120 to further distance the longer lay length twisted pairs 240*b*, 240*d*. This configuration will be further discussed below.

1. Randomized Cable Twist

The distance between adjacently positioned cables 120 can be maximized by twisting the adjacent cables 120 at different cable lay lengths. By being twisted at different rates, the peaks of one of the adjacent cables 120 do not align with the valleys of the other cable 120, thereby discouraging a nesting alignment of the cables 120 in relation to one another. Accordingly, the different lay lengths of the adjacent cables 120 help to prevent or discourage nesting of the adjacent cables 120. For example, the adjacent cables 120 shown in FIG. 1 have different lay lengths. Therefore, the number and size of the air pockets 160formed between the cables 120 are maximized.

The cable 120 can be configured to help ensure that adjacently placed sub-sections of the cable 120 do not have the same twist rate at any point along the length of the sub-sections. To this end, the cable 120 may be helically twisted along at least a predefined length of the cable 120. The helical twisting includes a torsional rotation of the cable about a generally longitudinal axis. The helical twisting of the cable 120 may be varied over the predefined length so that the cable lay length of the cable 120 either continuously increases or continuously decreases over the predefined length. For example, the cable 120 may be twisted at a certain cable lay length at a first point along the cable 120. The cable lay length can continuously decrease (the cable 120 is twisted tighter) along points of the cable 120 as a second point along the cable 120 is approached. As the twist of the cable 120 tightens, the distances between the spiraling ridges 180 along the cable 120 decrease. Consequently, when the predefined length of the cable 120 is separated into two sub-sections, and the sub-sections are positioned adjacent to one another, the sub-sections of the cable 120 will have different cable lay lengths. This discourages the sub-sections from nesting together because the ridges 180 of the cables 120 spiral at different rates, thereby reducing alien crosstalk between the sub-sections by maximizing the distance between them. Further, the different twist rates of the sub-sections help minimize alien crosstalk by maintaining a certain average distance between the sub-sections over the predefined length. In some embodiments, the average distance between the closest respective reference points 425 of each of the sub-sections is at least one-half the distance of the length of a particular filler extension 420 (the predefined extent) of the sub-sections over the predefined length.

Because the cable 120 is helically twisted at randomly varying rates along the predefined length, the filler 200, the twisted pairs 240, and/or the jacket 260 can be twisted correspondingly. Thus, the filler 200, the twisted pairs 240, and/or the jacket 260 can be twisted such that their respective lay lengths are either continuously increased or continuously decreased over at least the predefined length. In some embodiments, the jacket 260 is applied over the filler 200 and twisted pairs 240 in a compression fit such that the application of the jacket 260 includes a twisting of the jacket 260 that causes the tightly received filler 200 to be twisted in a corresponding manner. As a result, the twisted pairs 240 received within filler 200 are ultimately helically twisted with respect to one another. In practice, randomizing the lay lengths of the twisted pairs 240 once jacket 260 is applied such as by a twisting of the jacket has been found to have the added advantage or minimizing the re-introduction of air within cable 120. In contrast, other approaches to randomization typically increase air content, which may actually increase undesirable cross-talk. The importance of minimizing air content is discussed below in Section G.2. Nevertheless, in some embodiments, a twisting of the filler 200 independently of the jacket 260 causes the twisted pairs 240 received within the filler to be helically twisted with respect to one another.

The overall twisting of the cable 120 varies an original or initial predefined lay length of each of the twisted pairs 240. The twisted pairs 240 are varied by approximately the same rate at each point along the predefined length. The rate can be defined as the amount of torsional twist applied by the overall helical twisting of the twisted pairs 240. In response to the application of the torsional twist rate, the lay length of each of the twisted pairs 240 changes a certain amount. This function and its benefits will be further discussed in relation to FIGS. 11A–11B. The predefined length of the cable 120 will also be further discussed in relation to FIGS. 11A–11B.

2. Points of Contact

Figure 6A:
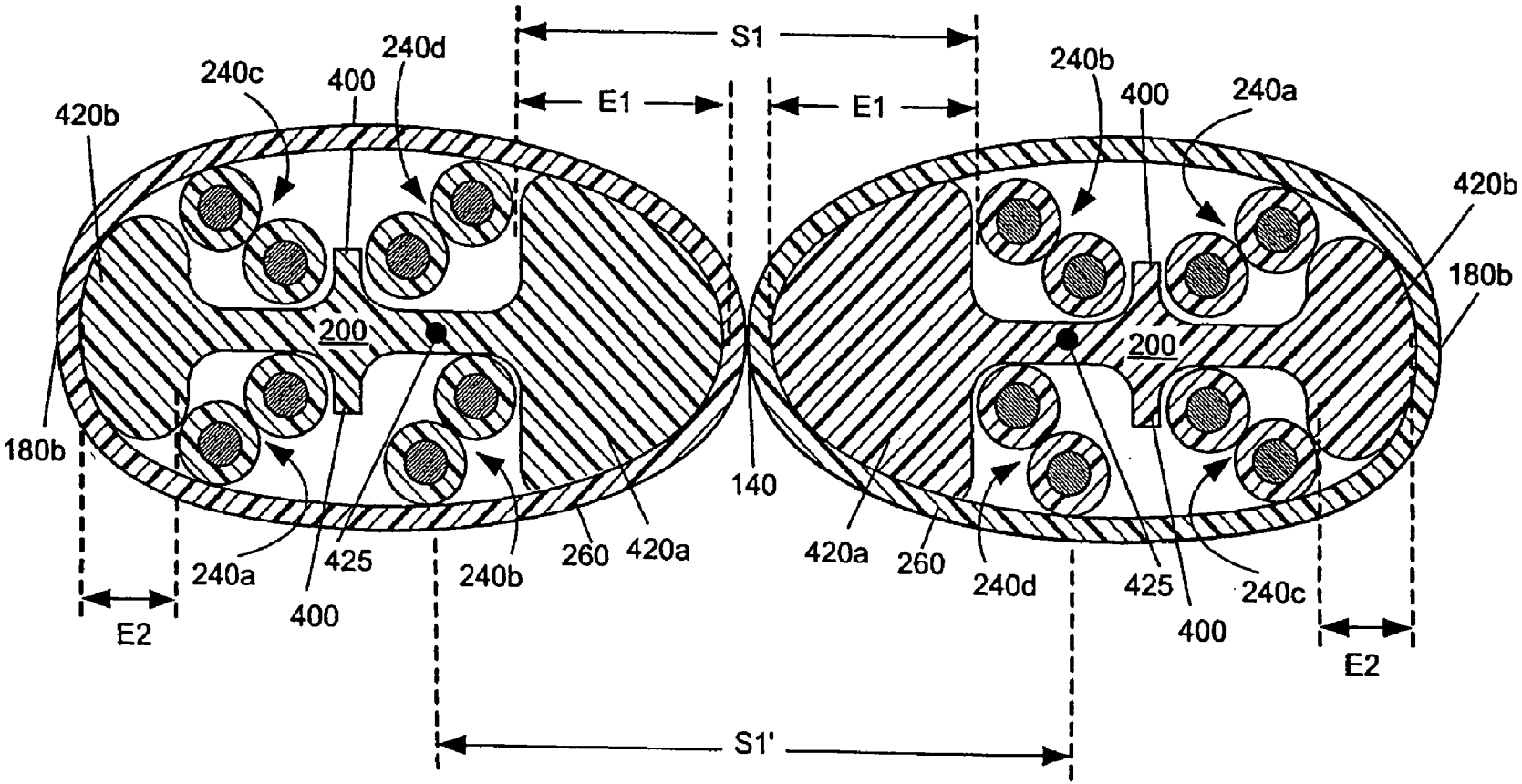
FIG. 6A shows a cross-sectional view of adjacent cables touching at a point of contact in accordance with the first embodiment of the invention.
Figure 6B:
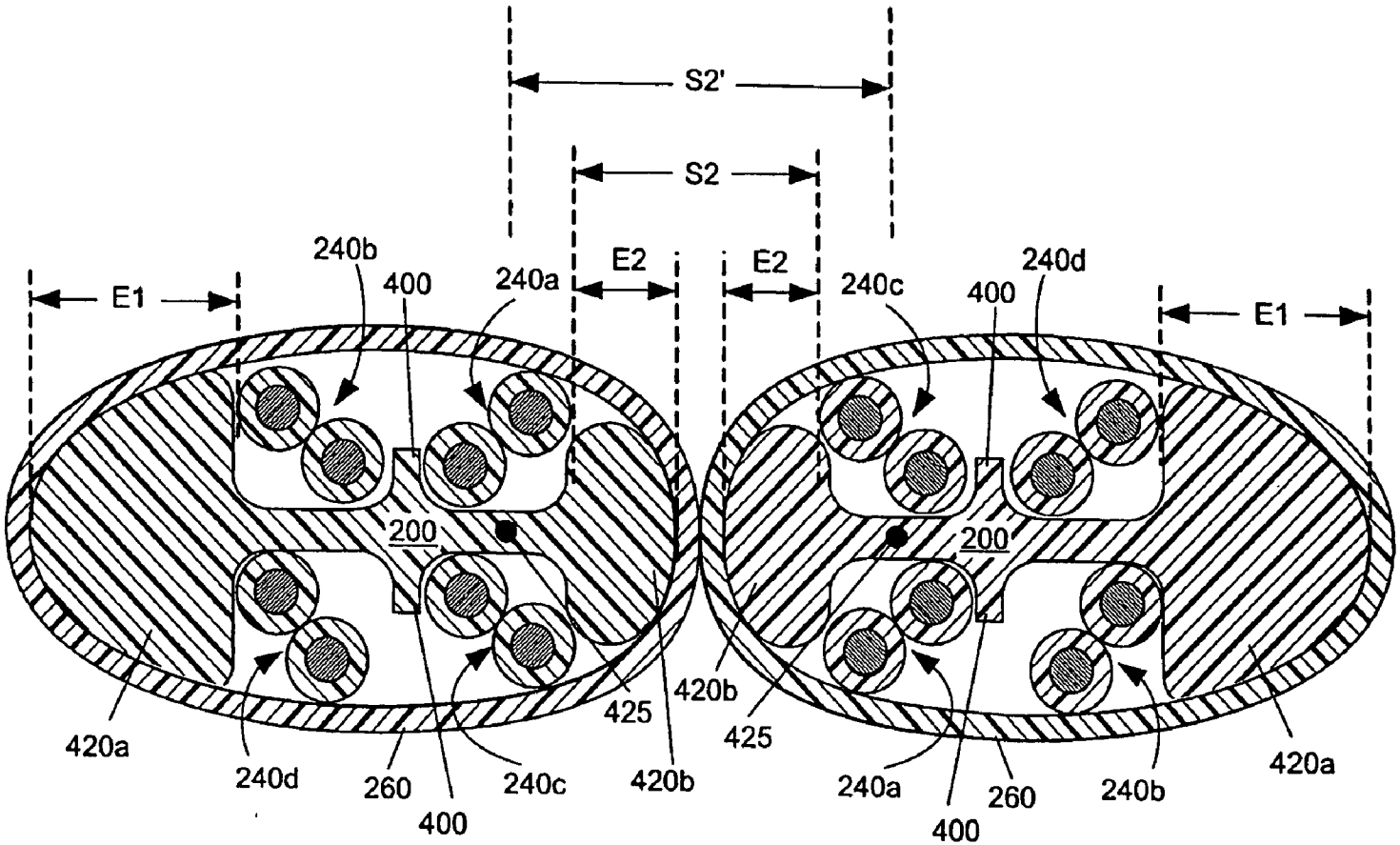
FIG. 6B shows a cross-sectional view of the adjacent cables of FIG. 6A at a different point of contact.

FIGS. 6A–6D show various cross-sectional views of longitudinally adjacent and helically twisted cables 120 according to the first embodiment of the invention. FIGS. 6A–6B show cross-sectional views of the cables 120 touching at different points of contact 140. At these positions, the filler extensions 420 can be configured to increase the distance between the twisted pairs 240 of adjacent cables 120, thereby minimizing alien crosstalk at the points of contact 140.

In FIG. 6A, the nearest twisted pairs 240 of the cables 120 are separated by the distance (S1). The distance (S1) equals approximately two times the sum of the extension length (E1) and the thickness of the jacket 260. In the cable 120 position shown in FIG. 6A, the filler extensions 420*a* of the cables 120 increase the distance between the nearest twisted pairs 240 of the cables 120 by twice the extension length (E1). The closest reference points 425 of the adjacent cables 120 shown in FIG. 6A are separated by the distance S1'.

In FIG. 6A, the adjacent cables 120 are positioned such that their respective longer lay length twisted pairs 240*b*, 240*d* are more proximate to each other than are the shorter lay length twisted pairs 240*a*, 240*c* of the cables 120. Because the longer lay length twisted pairs 240*b*, 240*d* are more prone to alien crosstalk than are the shorter lay length twisted pairs 240*a*, 240*c*, the larger filler extensions 420*a* of the cables 120 are selectively positioned to provide increased distance between the longer lay length twisted pairs 240*b*, 240*d* of the cables 120. Consequently, the longer lay length twisted pairs 240*b*, 240*d* of the cables 120 are further separated at the point of contact 140 shown in FIG. 6A, and thereby reducing alien crosstalk between them. In other words, the cables 120 can be configured to provide maximum separation between the longer lay length twisted pairs 240*b*, 240*d*. Accordingly, the filler 200 can selectively receive and house the twisted pairs 240. For example, the longer lay length twisted pairs 240*b*, 240*d* may be positioned most proximate to a longer filler extension 420*a*. This function is helpful for effectively minimizing alien crosstalk between the worst sources of alien crosstalk between the cables 120—the longer lay length twisted pairs 240*b*, 240*d*.

FIG. 6B shows a cross-sectional view of another point of contact 140 of the cables 120 along their lengths. In FIG. 6B, the nearest twisted pairs 240 of the cables 120 are separated by the distance (S2). The distance (S2) equals approximately two times the sum of the extension length (E2) and the thickness of the jacket 260. In the cable 120 position shown in FIG. 6B, the filler extensions 420*b* of the cables 120 increase the distance between the nearest twisted pairs 240 of the cables 120 by twice the extension length (E2). The closest reference points 425 of the adjacent cables 120 shown in FIG. 6B are separated by the distance S2'.

In FIG. 6B, the adjacent cables 120 are positioned such that their respective shorter lay length twisted pairs 240*a*, 240*c* are more proximate to each other than are the longer lay length twisted pairs 240*b*, 240*d* of the cables 120. The shorter lay length twisted pairs 240*a*, 240*c* of the cables 120 are separated at the point of contact 140 shown in FIG. 6B by at least the lengths of the filler extensions 420*b*, thereby reducing alien crosstalk between them. Because the shorter lay length twisted pairs 240*a*, 240*c* are less prone to alien crosstalk than are the longer lay length twisted pairs 240*b*, 240*d*, the smaller filler extensions 420*b* of the cables 120 are selectively positioned to distance the shorter lay length twisted pairs 240*a*, 240*c* of the cables 120. As discussed above, increased distance is more helpful for reducing alien crosstalk between the longer lay length twisted pairs 240*b*, 240*d*. Therefore, the larger filler extensions 420*a* of the cables 120 are used to separate the longer lay length twisted pairs 240*b*, 240*d* at positions where they are most proximate between the cables 120.

3. Non-contact Points

Figure 6C:
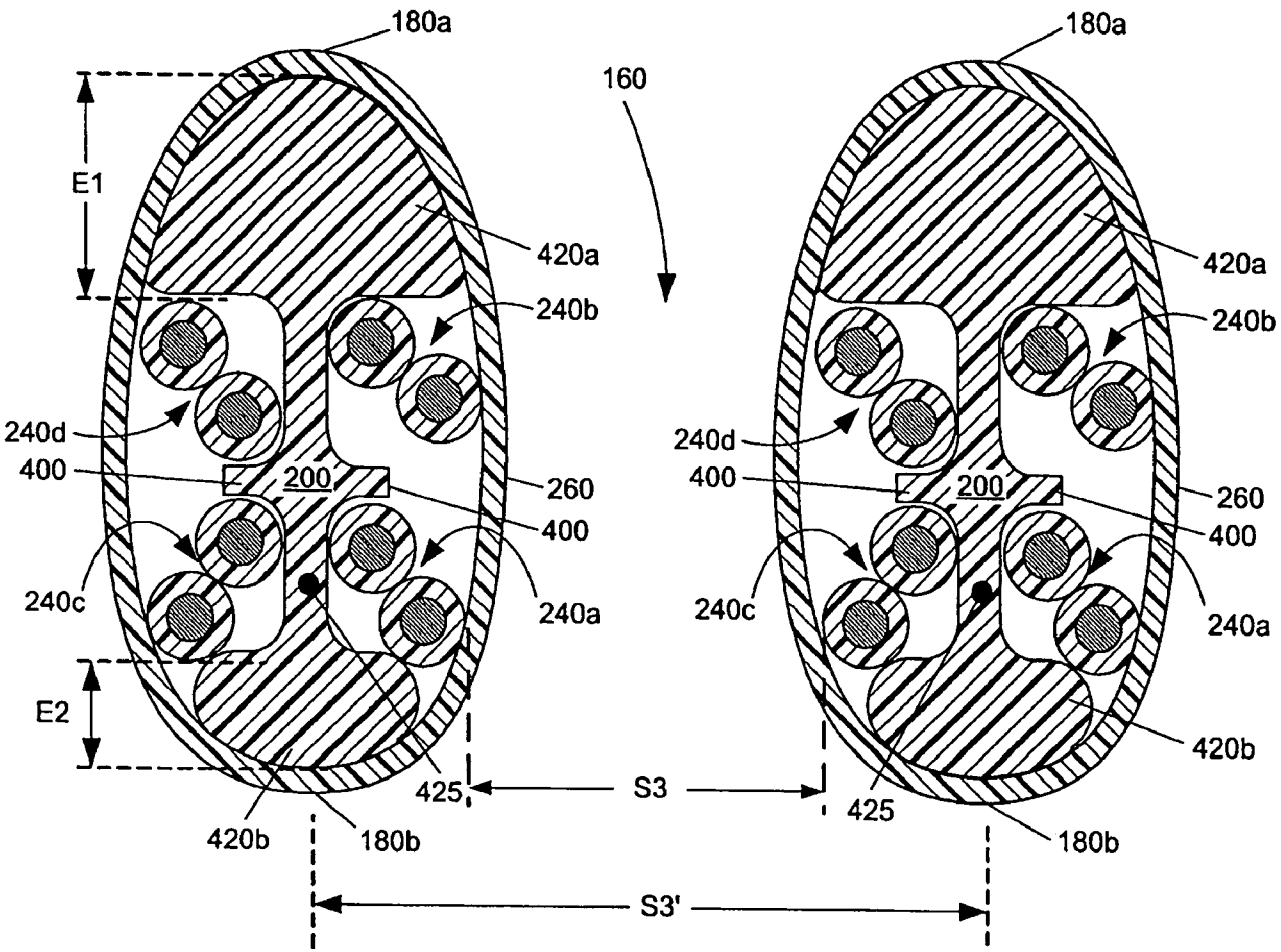
FIG. 6C shows a cross-sectional view of the adjacent cables of FIG. 6A separated by an air pocket.
Figure 6D:
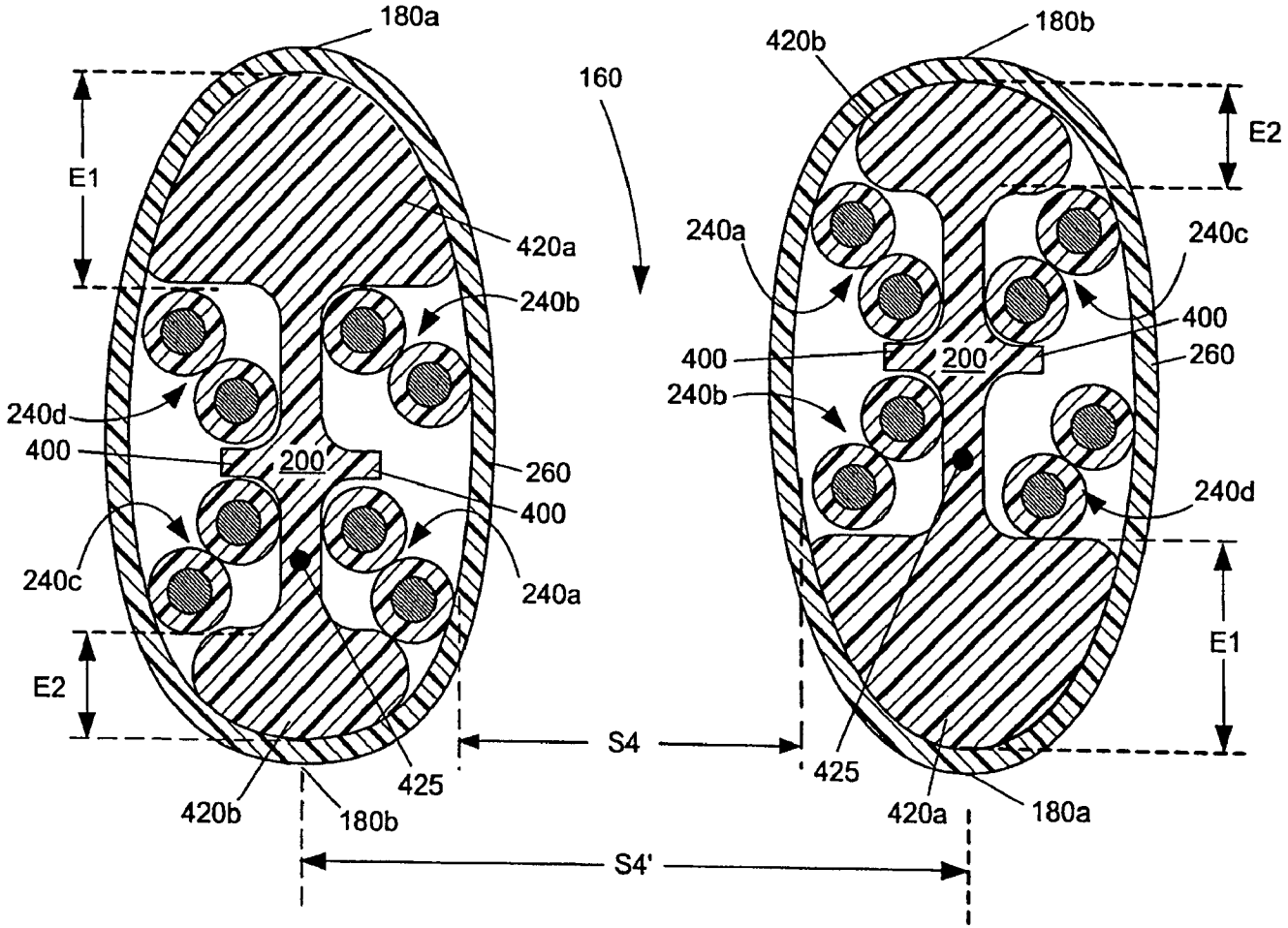
FIG. 6D shows a cross-sectional view of the adjacent cables of FIG. 6A separated by another air pocket.

FIGS. 6C–6D show cross-sectional views of the cables 120 at non-contact points along their lengths. At these positions, the cables 120 can be configured to increase the distance between the twisted pairs 240 of adjacent cables 120 by forming the air pockets 160 between the cables 120, thereby minimizing alien crosstalk at the points of contact 140. When the adjacent cables 120 are independently and helically twisted at different cable lay lengths, the filler extensions 420 help form the air pockets 160 by helping to prevent the cables 120 from nesting together. As discussed above, this distancing effect can be maximized by creating slight fluctuations in twist rotation along the longitudinal axes of the cables 120.

The air pockets 160 increase the distances between the twisted pairs 240 of the cables 120. FIG. 6C shows a cross-sectional view of the adjacent cables 120 separated by a particular air pocket 160 at a position along their longitudinal lengths. At the position illustrated in FIG. 6C, the adjacent cables 120 are separated by the air pocket 160. While at this position, the air pocket 160 formed by the helically rotating ridges 180 functions to distance the most proximate twisted pairs 240 of each cable 120. The length of the air pocket 160 is the increased distance between the adjacent cables 120. In FIG. 6C, the distance between the nearest twisted pairs 240 of the cables 120 at this position is indicated by the distance (S3). Because air has excellent insulation properties, the distance formed by the air pocket 160 is effective for isolating the adjacent cables 120 from alien crosstalk. In FIG. 6C, the closest reference points 425 of the adjacent cables 120 are separated by the distance S3'.

The cables 120 can be configured such that when their twisted pairs 240 are not separated by the filler extensions 420, the air pockets 160 are formed to distance the twisted pairs 240 of the cables 120, thereby helping to reduce alien crosstalk between the cables 120.

FIG. 6D shows a cross-sectional view of the adjacent cables 120 at another air pocket 160 along their longitudinal lengths. Similar to the position shown in FIG. 6C, the cables 120 of FIG. 6D are separated by the air pocket 160. As discussed in relation to FIG. 6C, the air pocket 160 shown in FIG. 6D functions to distance the nearest twisted pairs 240 of the cables 120. The distance between the nearest twisted pairs 240 of the cables 120 at this position is indicated by the distance (S4). In FIG. 6D, the closest reference points 425 of the adjacent cables 120 are separated by the distance S4'.

Although FIGS. 6A–6D show specific embodiments of the cables 120, other embodiments of the cables 120 can be configured to increase the distances between the twisted pairs 240 of adjacent cables 240. For example, a wide variety of filler extension 420 configurations can be used to increase the distance between the adjacent cables 120. The filler 200 can include different numbers and sizes of the filler extensions 420 and the filler dividers 400 that are configured to prevent nesting of adjacent cables 120. The filler 200 can include any shape or design that helps to distance the adjacent cables 120 while complying with the industry standards for cable size or diameter.

Figure 7:
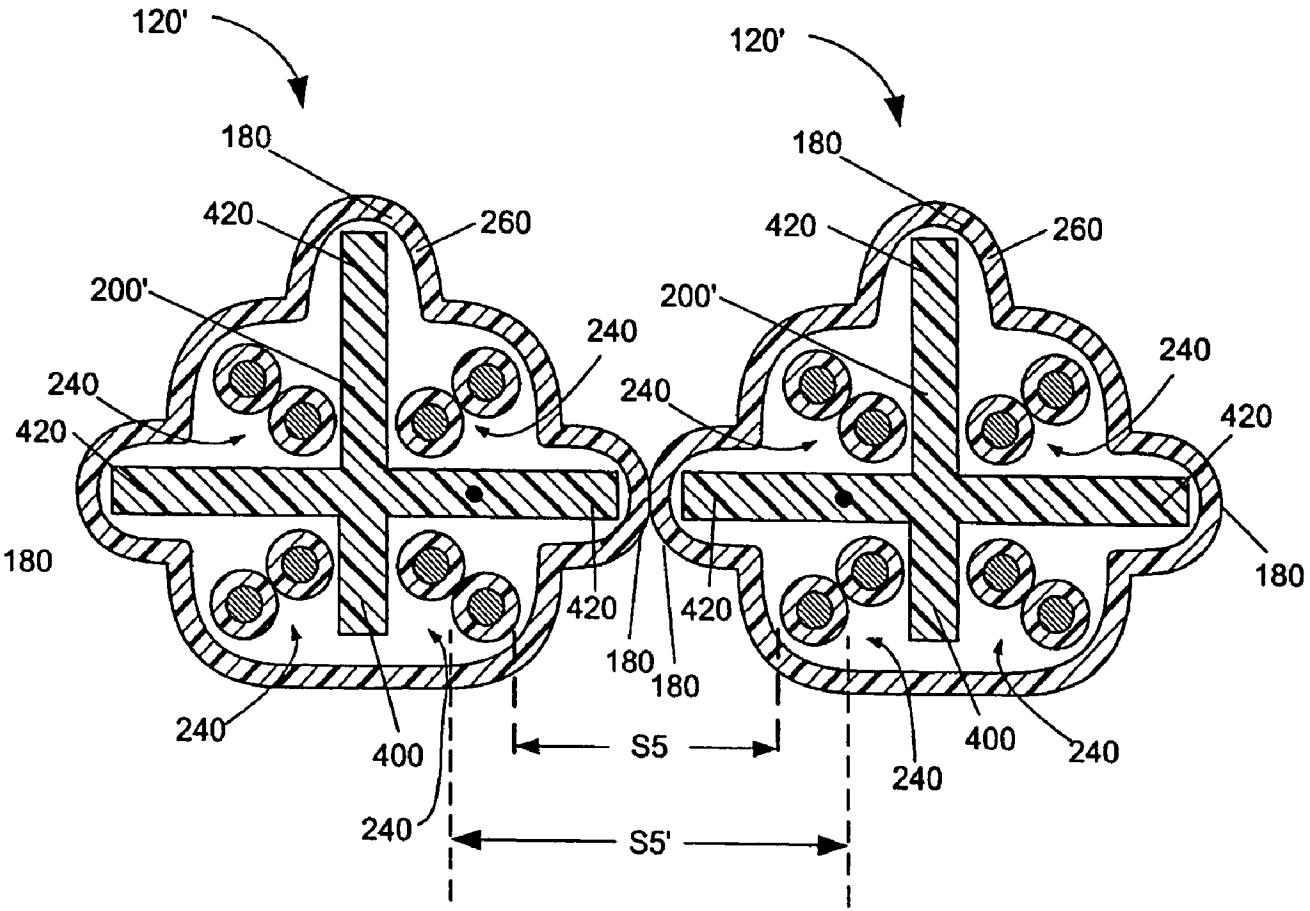
FIG. 7 is a cross-sectional view of longitudinally adjacent cables according to the first alternate embodiment.

For example, FIG. 7 is a cross-sectional view of longitudinally adjacent cables 120' according to the second embodiment of the invention. The cables 120' shown in FIG. 7 can be positioned similarly to the cables 120 shown in FIGS. 6A–6D. Each of the cables 120' includes the jacket 260 surrounding the filler 200', the filler divider 400, the filler extensions 420, and the twisted pairs 240. The cables 120' also include the ridges 180 formed along the jackets 260 by the filler extensions 420. The elevated ridges 180 help to increase the distance between the twisted pairs 240 of the adjacent cables 120 because the points of contact 140 between the cables 120' occur at the ridges 180 of the cables 120'.

In FIG. 7, each cable 120' includes three filler extensions 420 that extend beyond the cross-sectional areas of some of the twisted pairs 240. The filler extensions 420 in FIG. 7 can function in any of the ways discussed above, such as helping to prevent nesting of helically twisted adjacent cables 120' and increasing the distances between the twisted pairs 240 of the cables 120'. In FIG. 7, the distance between the nearest twisted pairs 240 of the cables 120' at one of the point of contact 140 is indicated by the distance (S5), which is approximately two times the sum of the extension length and the thickness of the jacket 260 the cable 120'. The closest reference points 425 of the adjacent cables 120' shown in FIG. 7 are separated by the distance S5'. The cables 120' shown in FIG. 7 can selectively position the twisted pairs 240 of different lay lengths in any of the ways discussed above. Accordingly, the cables 120' of FIG. 7 can be configured to minimize alien crosstalk.

Figure 8:
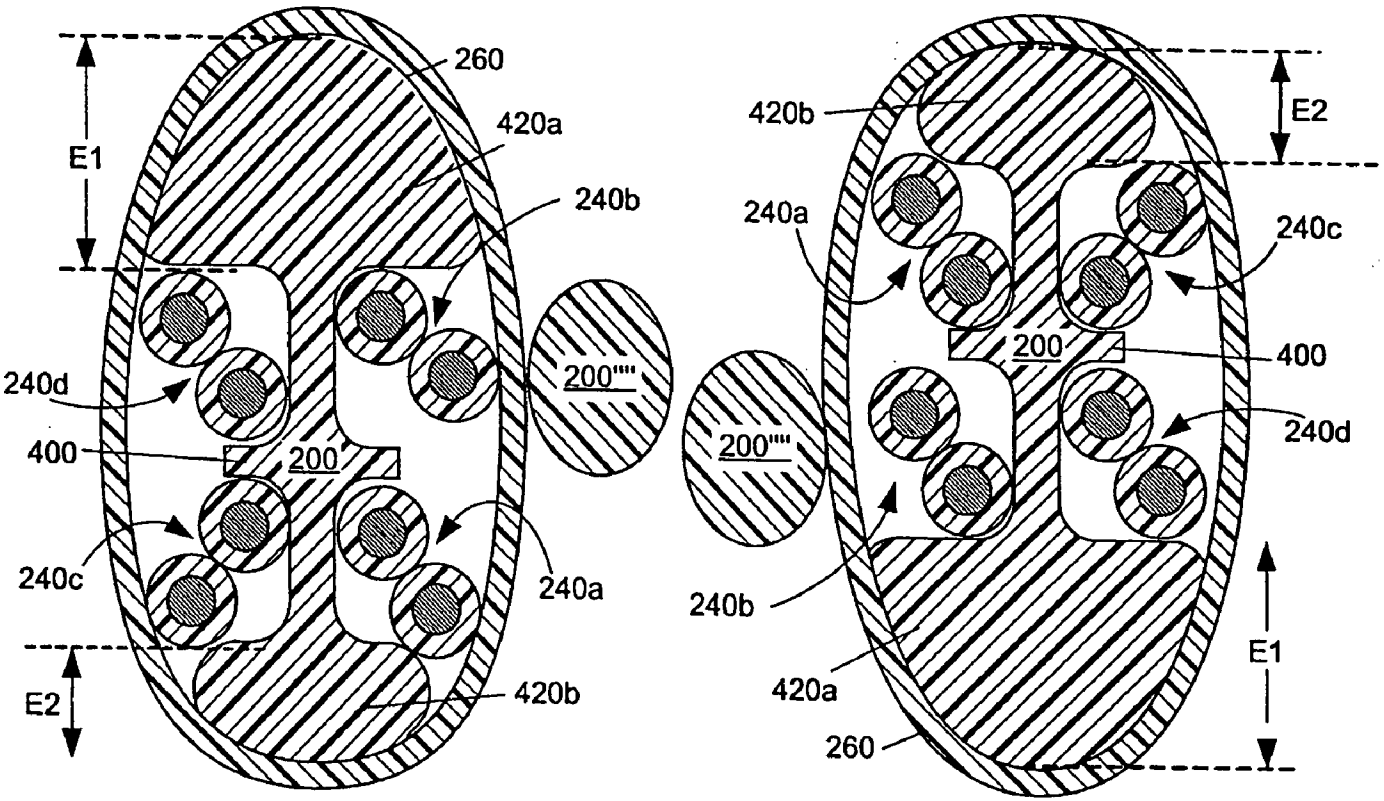
FIG. 8 is a cross-sectional view of longitudinally adjacent cables and fillers using the arrangement of FIG. 4D.

FIG. 8 is an enlarged cross-sectional view of the longitudinally adjacent cables 120 and the fillers 200"" using the arrangement of FIG. 4D. The cables 120 shown in FIG. 8 are distanced by the helically twisting filler 200"" in any of the ways discussed above in relation to FIG. 4D.

F. Selective Distance Maximization

The present cable configurations can minimize signal degradation by providing for selective positioning of the twisted pairs 240. Referring again to FIG. 4A, the twisted pairs 240*a*, 240*b*, 240*c*, and 240*d* can be independently twisted at dissimilar lay lengths. In FIG. 4A, the twisted pair 240*a* and the twisted pair 240*c* have shorter lay lengths than the longer lay lengths of the twisted pair 240*b* and the twisted pair 240*d*.

As mentioned above, crosstalk more readily affects the twisted pairs 240 with long lay lengths because the conductors 300 of long lay length twisted pairs 240*b*, 240*d* are oriented at relatively smaller angles from a parallel orientation. On the other hand, shorter lay length twisted pairs 240*a*, 240*c* have higher angles of separation between their conductors 300, and are, therefore, farther from being parallel and less susceptible to crosstalk noise. Consequently, twisted pair 240*b* and twisted pair 240*d* are more susceptible to crosstalk than are twisted pair 240*a* and twisted pair 240*c*. With these characteristics in mind, the cables 120 can be configured to reduce alien crosstalk by maximizing the distance between their long lay length twisted pairs 240*b*, 240*d*.

The long lay length pairs 240*b*, 240*d* of adjacent cables 120 can be distanced by positioning them proximate to the largest filler extension 420*a*. For example, as shown in FIG. 4A, the extension length (E1) of filler extension 420*a* is greater than the extension length (E2) of filler extension 420*b*. By positioning the twisted pairs 240*b*, 240*d* with longer lay lengths proximate to the cable's 120 largest filler extension 420*a*, the points of contact 140 that occur between the filler extensions 420*a* of the adjacent cables 120 will provide maximum distance between the long lay length twisted pairs 240*b*, 240*d*. In other words, the longer lay length twisted pairs 240 are positioned more proximate to the larger filler extension 420*a* than are the shorter lay length twisted pairs 240. Accordingly, the long lay length twisted pairs 240*b*, 240*d* of the cables 120 are separated at the point of contact 140 by at least the greatest available extension lengths (E1). This configuration and its benefits will be further explained with reference to the embodiments shown in FIGS. 9A–9D.

FIGS. 9A–9D show cross-sectional views of longitudinally adjacent cables 120" according to the third embodiment of the inventions. In FIGS. 9A–9D, the twisted adjacent cables 120" include the long lay length twisted pairs 240*b*, 240*d* configured to maximize the distance between the long lay length twisted pairs 240*b*, 240*d* of the adjacent cables 120". The cables 120" each include the twisted pairs 240*a*, 240*b*, 240*c*, 240*d* with dissimilar lay lengths. The long lay length twisted pairs 240*b*, 240*d* are positioned most proximate to the longest filler extension 420 of the filler 200" of each cable 120". This configuration helps minimize alien crosstalk between the long lay length twisted pairs 240*b*, 240*d* of the cables 120". FIGS. 9A–9D show different cross-sectional views of the twisted adjacent cables 120" at different positions along their longitudinally extending lengths.

Figure 9A:
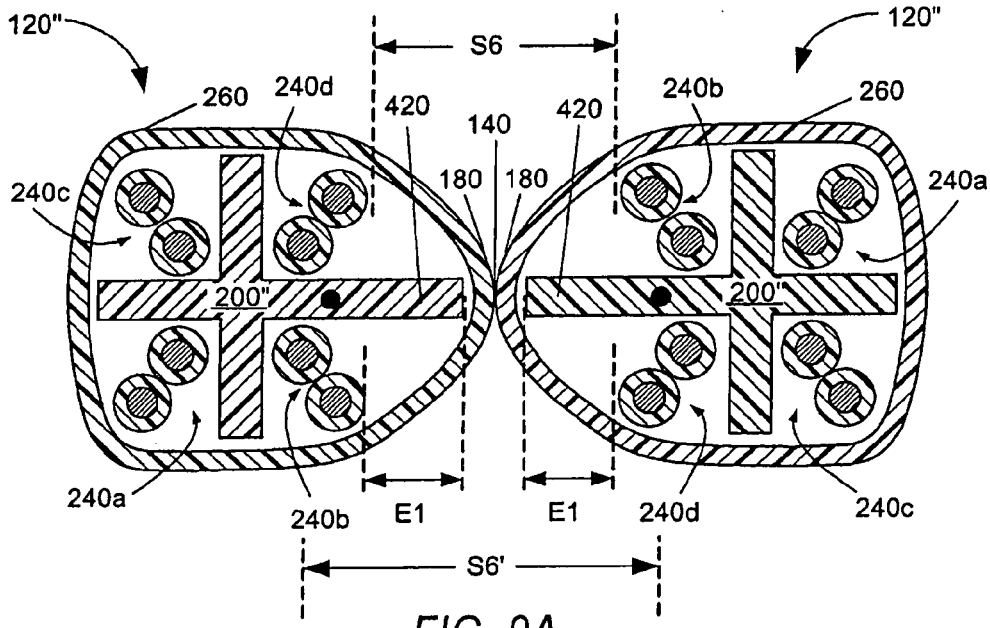
FIG. 9A is a cross-sectional view of the third embodiment of twisted adjacent cables configured to distance the cables' long lay length twisted pairs.

FIG. 9A is a cross-sectional view of an embodiment of twisted adjacent cables 120" configured to distance the cables' 120" long lay length twisted pairs 240*b*, 240*d*. As shown in FIG. 9A, the cables 120" are positioned such that the filler extensions 420 of each of the cables 120" are oriented toward each other. The point of contact 140 is formed between the cables 120" at the ridges 180 located between the filler extensions 420. As the cables 120" are positioned in FIG. 9A, the distance between the long lay twisted pairs 240*b*, 240*d* is approximately the sum of the lengths that the filler extensions 420 extend beyond the cross-sectional area of the twisted pairs 240*b*, 240*d*, indicated by the distances (E1), and the jacket 260 thicknesses of each of the cables 120". This sum is indicated by the distance (S6). In FIG. 9A, the closest reference points 425 of the adjacent cables 120" are separated by the distance S6'. The configuration shown in FIG. 9A helps minimize alien crosstalk in any of the ways discussed above in relation to FIGS. 6A–6D.

Figure 9B:
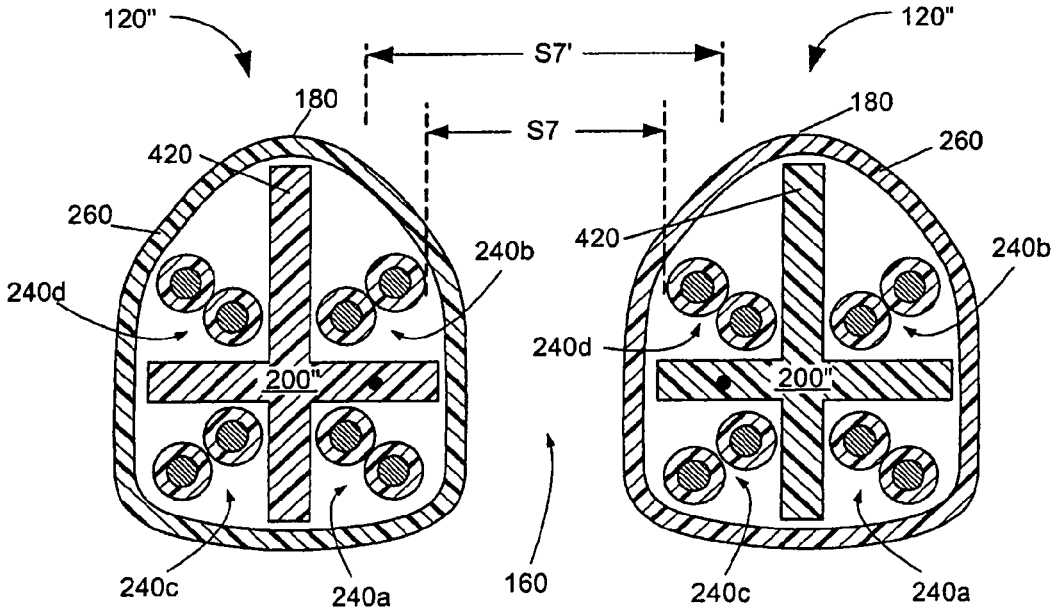
FIG. 9B is another cross-sectional view of the twisted adjacent cables of FIG. 9A at a different position along their longitudinally extending sections.

FIG. 9B shows another cross-sectional view of the twisted adjacent cables 120" at another position along the lengths of the longitudinally adjacent cables 120". As the cables 120" rotate the filler extensions 420 move with the rotation. In FIG. 9B, the filler extensions 420 of the cables 120" are parallel and oriented generally upward. Because the filler extension 420 causes the cable 120" to be offset, the air pocket 160 is formed between the cables 120" at this orientation of the filler extensions 420. The configuration shown in FIG. 9B helps to reduce alien crosstalk in any of the ways discussed above in relation to FIGS. 6A–6D. For example, as discussed above, the air pocket 160 helps to reduce alien crosstalk by maximizing the distance between the twisted pairs 240 of the cables 120". The distance (S7) indicates the separation between the nearest twisted pairs 240 of the cables 120". In FIG. 9B, the closest reference points 425 of the adjacent cables 120" are separated by the distance S7'.

Figure 9C:
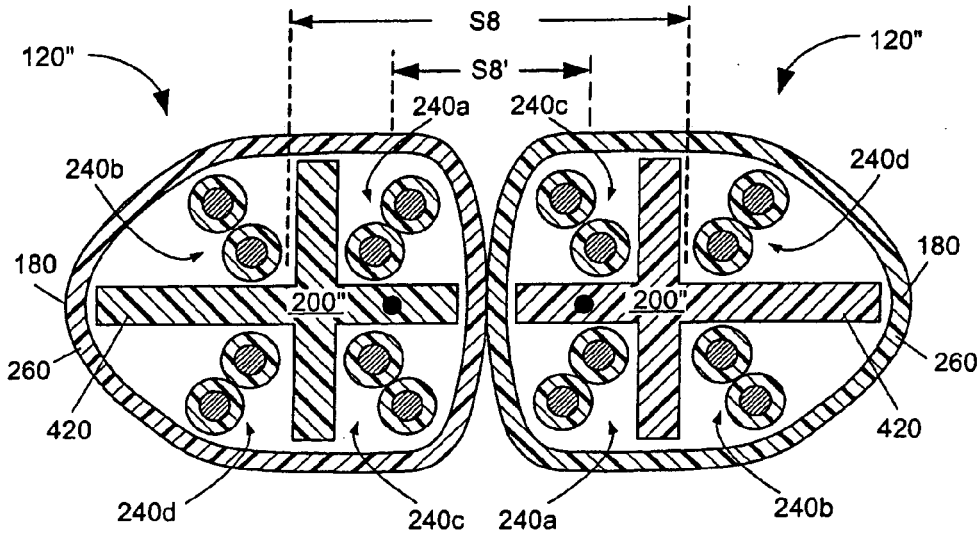
FIG. 9C is another cross-sectional view of the twisted adjacent cables of FIGS. 9A–9B at a different position along their longitudinally extending sections.

FIG. 9C shows another cross-sectional view of the twisted adjacent cables 120" of FIG. 9A at a different position along the lengths of the longitudinally adjacent cables 120". At this point, the filler extensions 420 of the cables 120" are oriented away from each other. The long lay length twisted pairs 240*b*, 240*d* are selectively positioned proximate to the filler extension 420. Accordingly, the long lay length twisted pairs 240*b*, 240*d* are also oriented apart. The short lay length twisted pairs 240*a*, 240*c* of each cable 120" are most proximate to each other. However, as mentioned above, the short lay length twisted pairs 240*a*, 240*c* are not as susceptible to crosstalk as are the long lay length twisted pairs 240*b*, 240*d*. Therefore, the orientation of the cables 120" shown in FIG. 9C does not unacceptably harm the integrity of high-speed signals as they are propagated along the twisted pairs 240. Other embodiments of the cables 120" include filler extensions 420 configured to further distance the short lay length twisted pairs 240*a*, 240*c*.

At the position shown in FIG. 9C, the long lay length twisted pairs 240*b*, 240*d* are naturally separated by the components of the cables 120". Specifically, the areas of the short lay length twisted pairs 240*a*, 240*c* of the cables 120" helps separate the long lay length twisted pairs 240*b*, 240*d*. Therefore, alien crosstalk is reduced at the configuration of the cables 120" shown in FIG. 9C. The distance between the long lay length twisted pairs 240*b*, 240*d* of the cables 120" is indicated by the distance (S8). In FIG. 9C, the closest reference points 425 of the adjacent cables 120" are separated by the distance S8'.

Figure 9D:
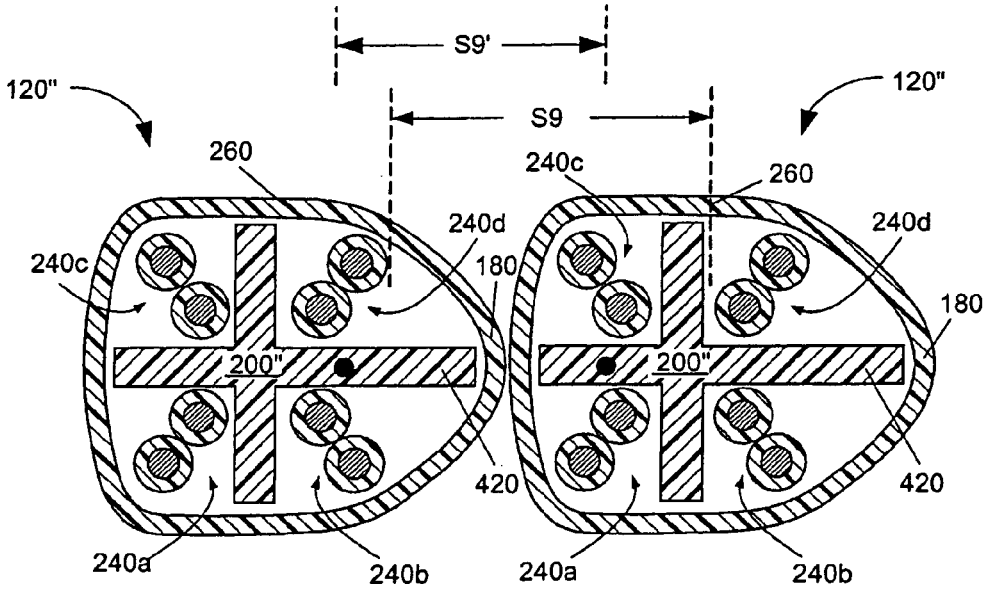
FIG. 9D is another cross-sectional view of the twisted adjacent cables of FIGS. 9A–9C at a different position along their longitudinally extending sections.

FIG. 9D shows another cross-sectional view of the twisted adjacent cables 120" at another position along the lengths of the longitudinally adjacent cables 120". At the position shown in FIG. 9D, the filler extensions 420 of both cables 120" are oriented in the same lateral direction. The long lay length twisted pairs 240*b*, 240*d* of each of the cables 120" remain distanced apart by the distance (S9), thus minimizing the effects of alien crosstalk between the long lay length twisted pairs 240*b*, 240*d*. Further, the components of the cables 120", including the short lay length twisted pairs 240*a*, 240*c* of one of the cables 120" helps separate the long lay length twisted pairs 240*b*, 240*d* of the cables 120". In FIG. 9D, the closest reference points 425 of the adjacent cables 120" are separated by the distance S9'.

G. Capacitive Field Balance

The present cables 120 can facilitate balanced capacitive fields about the conductors 300 of the twisted pairs 240. As mentioned above, capacitive fields are formed between and around the conductors 300 of a particular twisted pair 240. Further, the extent of capacitive unbalance between the conductors 300 of the twisted pair 240 affects the noise emitted from the twisted pair 240. If the capacitive fields of the conductors 300 are well-balanced, the noise produced by the fields tends to be canceled out. Balance is typically promoted by insuring that the diameter of the conductors 300 and the insulators 320 of the twisted pair 240 are uniform. As mentioned earlier, the cable 120 utilizes twisted pairs 240 with uniform sizes that facilitate capacitive balance.

However, materials other than the insulators 320 affect the capacitive fields of the conductors 300. Any material within or proximate to a capacitive field of the conductors 300 affects the overall capacitance, and ultimately the capacitive balance, of the insulated conductors 300 grouped into the twisted pair 240. As shown in FIG. 4A, the cable 120 may include a number of materials positioned where they may separately affect each insulated conductor's 300 capacitance within the twisted pair 240. This creates two different capacitances, thus creating an unbalance. This unbalance inhibits the ability of the twisted pair 240 to self-cancel noise sources, resulting in increased noise levels radiating from an active transmitting pair 240. The insulator 320, the filler 200, the jacket 260, and the air within the cable 120 can all affect the capacitive balance of the twisted pairs 240. The cable 120 can be configured to include materials that help minimize any unbalancing effects, thereby maintaining the integrity of the high-speed data signals and reducing signal attenuation.

1. Consistent Dielectric Materials

The cable 120 can minimize capacitive unbalance by using materials with consistent dielectric properties, such as consistent dielectric constants. The materials used for the jacket 260, the filler 200, and the insulators 320 can be selected such that their dielectric constants are approximately the same or at least relatively close to each other. Preferably, the jacket 260, the filler 200, and the insulators 320 should not vary beyond a certain variation limit. When the materials of these components comprise dielectrics within the limit, capacitive unbalance is reduced, thereby maximizing noise attenuation to help maintain high-speed signal integrity. In some embodiments, the dielectric constant of the filler 200, the jacket 260, and the insulator 320 are all within approximately one dielectric constant of each other.

By utilizing materials with consistent dielectric properties, the cable 120 minimizes capacitive unbalance by eliminating bias that may be formed by materials with different dielectric constants positioned uniquely about the twisted pair 240, especially in consequence of stronger capacitive fields generated by high-speed data signals. For example, a particular twisted pair 24 includes two conductors 300. A first conductors may be positioned proximate to the jacket 26 while the second conductor is positioned proximate to the filler 200. Consequently, the first conductor's 300 capacitive fields may experience more capacitive influence from the more proximate jacket 260 than from the less proximate filler 200. The second conductor 300 may be more biased by the filler 200 than by the jacket 260. As a result, the unique biases of the conductors 300 do not cancel each other out, and the capacitive fields of the twisted pair 240 are unbalanced. Further, a greater disparity between the dielectric constants of the jacket 260 and the filler 200 will undesirably increase the unbalance of the twisted pair 240, thereby causing signal degradation. The cable 120 can minimize the bias differences, i.e., the capacitive unbalance, by utilizing materials with consistent dielectric constants for the insulator 320, the filler 200, and the jacket 260. Consequently, the capacitive fields about the conductors 300 are better balanced and result in improved noise cancellations along the length of each twisted pair within the cable 120.

In some embodiments, the jacket 260 may include an inner jacket and an outer jacket with dissimilar dielectric properties. In some embodiments, a dielectric of the inner jacket, said filler 200, and said insulator 320 are all within approximately one dielectric constant (1) of each other. In some embodiments, a dielectric of the outer jacket is not within approximately one dielectric constant of said insulator 320. In some embodiments, there is no material within a predefined dimension from the center of the conductor 300 with a dielectric constant that varies more than approximately plus or minus one dielectric constant from the dielectric constant of the insulator 320. In some embodiments, the predefined dimension is a radius of approximately 0.025 inches (0.635 mm).

2. Air Minimization

Because air is typically more than 1.0 dielectric constant different than the insulator 320, filler 200 material, or the jacket 260, the cable 120 can facilitate a balance of the twisted pair's 240 overall capacitive fields by minimizing the amount of air about the twisted pair 240. The amount of air can be reduced by enlarging or otherwise maximizing the area of the filler 200 for the cable 120. For example, as discussed above in relation to FIG. 4A, the area of the filler extensions 420 and/or the filler dividers 400 may be increased. As shown in FIG. 4A, the filler extensions 420 of the cable 120 are expanded toward the jacket 260 to increase the cross-sectional area of the filler extensions 420.

Further, as discussed above in relation to FIG. 4A, the filler 200, including the filler dividers 400 and the filler extensions 420, can include edges shaped to fittingly accommodate the twisted pairs 240, thereby minimizing the spaces in the cable 120 where air could reside. In some embodiments, the filler 200, including the filler extensions 420 and the filler dividers 400, includes curved edges shaped to house the twisted pairs 240. Further, as discussed above in relation to FIG. 4A, the filler extensions 420 may include curved outer edges configured to fittingly nest with the jacket 260, thereby displacing air from between the filler extensions 420 and the jacket 260 when the jacket 260 is snugly or tightly fitted around the filler extensions 420.

The reduction in the voids of cable 120 selectively receiving a gas such as air proximate to the twisted pair 240 helps minimize the materials with disparate dielectric constants. As a result, the unbalance of the twisted pair's 240 capacitive fields is minimized because biases toward uniquely positioned materials are prevented or at least attenuated. The overall effect is a decrease in the effects of noise emitted from the twisted pair 240. In some embodiments, the voids able to hold a gas such as air within the cross-sectional area of the twisted pair 240 makes up less than a predetermined amount of the cross-sectional area of the twisted pair 240 or of the region housing the twisted pair 240. In some embodiments, the gas within the voids makes up less than the predetermined amount of the cross-sectional area of the cable 120. In some embodiments, the amount of gas within the cable 120 is less that the predetermined amount of the volume of the cable 120 over a predefined distance. In some embodiments, the predetermined amount is ten percent.

By limiting the voids and the corresponding amount of a gas such as air within the cable 120 to less than the predetermined amount, the cable 120 has improved performance. The dielectrics about the twisted pairs 240 are made more consistent. As discussed above, this helps reduce the noise emitted from the twisted pairs 240. Consequently, the cables 120 are better able to accurately transmit high-speed data signals.

Figure 10:
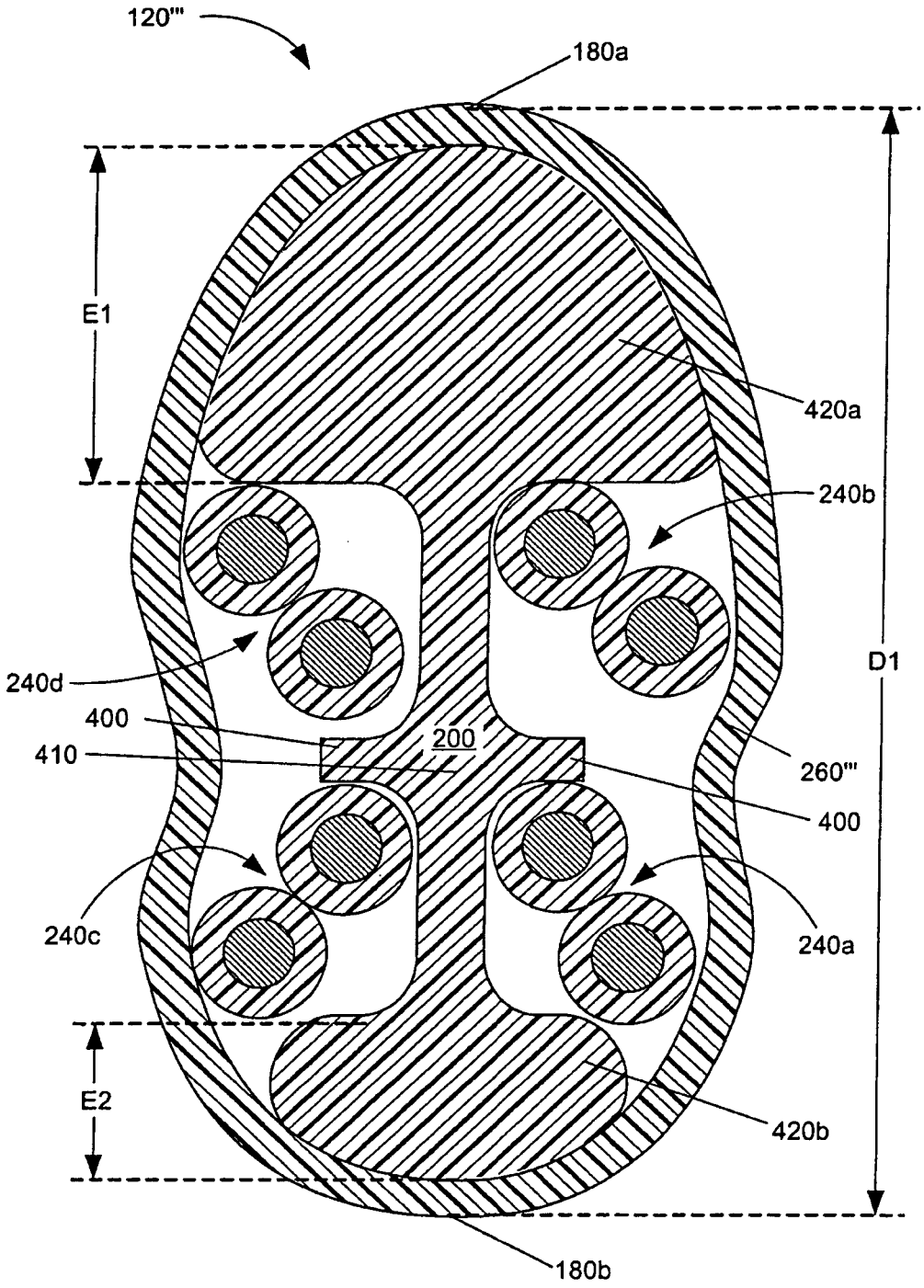
FIG. 10 shows an enlarged cross-sectional view of a cable according to a further embodiment.

FIG. 10 shows a cross-sectional view of an example of an alternative embodiment of a cable 120'''. The cable 120''' of FIG. 10 shows a jacket 260''' even more tightly fitted around the twisted pairs 240. The cable 120''' illustrates that the jacket 260''' can be fitted around the cable 120''' in a number of different configurations that help minimize the voids able to retain a gas such as air within the cable 120'''.

H. Impedance Uniformity

The reduction in the amount of air within the cable 120 discussed above also helps maintain the integrity of propagating signals by minimizing the impedance variations along the length of the cable 120. Specifically, the cable 120 can be configured such that its components are generally fixed in position within the jacket 260. The components within the jacket 260 can be generally fixed by reducing the amount of air within the jacket 260 in any of the ways discussed above. Specifically, the twisted pairs 240 can be generally fixed in position with respect to one another. In some embodiments, the jacket 260 fits over the twisted pairs 240 in such a manner that it fixes the twisted pairs 240 in position. Typically, a compression fit is used, although it is not required. In other embodiments, a further material such as an adhesive may be used. In yet other embodiments, the filler 200 is configured to help generally fix the twisted pairs 240 in position. In some preferred embodiments, the components of the cable 120, including the twisted pairs 240, are firmly fixed in position with respect to one another.

The cable 120, by having fixed physical characteristics, is able to minimize impedance variations. As discussed above, any change in the physical characteristics or relations of the twisted pairs 240 is likely to result in an unwanted impedance variation. Because the cable 120 can include fixed physical attributes, the cable 120 can be manipulated, e.g., helically twisted, without introducing significant impedance deviations into the cable 120. The cable 120 can be helically twisted after it has been jacketed without introducing hazardous impedance deviations, including during manufacture, testing, and installation procedures. Accordingly, the cable lay length of the cable 120 can be changed after it has been jacketed. In some embodiments, the physical distances between the twisted pairs 240 of the cable 120 do not change more than a predefined amount, even as the cable 120 is helically twisted. In some embodiments, the predefined amount is approximately 0.01 inches (0.254 mm).

The generally locked physical characteristics of the cable 120 help to reduce attenuation due to signal reflections because less signal strength is reflected at any point of impedance variation along the cable 120. Thus, the cable 120 configurations facilitate the accurate and efficient propagations of high-speed data signals by minimizing changes to the physical characteristics of the cable 120 over its length.

Further, materials with beneficial and consistent dielectric properties are used about the conductors 300 to help minimize impedance variations over the length of the cable 120. Any variation in physical attributes of the cable 120 over its length will enhance any existing capacitive unbalance of the twisted pair 240. The use of consistent dielectric materials reduces any capacitive biases within the twisted pairs 24. Consequently, any physical variation will enhance only minimized capacitive biases. Therefore, by using materials with consistent dielectrics proximate to the conductors 300, the effects of any physical variation in the cable 120 are minimized.

I. Cable Lay Length Limitations

The present cables 120 can be configured to reduce alien crosstalk by minimizing the occurrences of parallel cross-over points between adjacent cables 120. As mentioned above, parallel cross-over points between the twisted pairs 240 of the adjacent cables 120 are a significant source of alien crosstalk at high-speed data rates. The parallel points occur wherever twisted pairs 240 with identical or similar lay lengths are adjacent to each other. To minimize the parallel cross-over points between the adjacent cables 120, the cables 120 can be twisted at dissimilar and/or varying lay lengths. When the cable 120 is helically twisted, the lay lengths of its twisted pairs 240 are changed according to the twisting of the cable 120. Therefore, the adjacent cables 120 can be helically twisted at dissimilar overall cable 120 lay lengths in order to differentiate the lay lengths of the twisted pairs 240 of one of the cables 120 from the lay lengths of the twisted pairs 240 of adjacent cables 120.

Figure 11A:
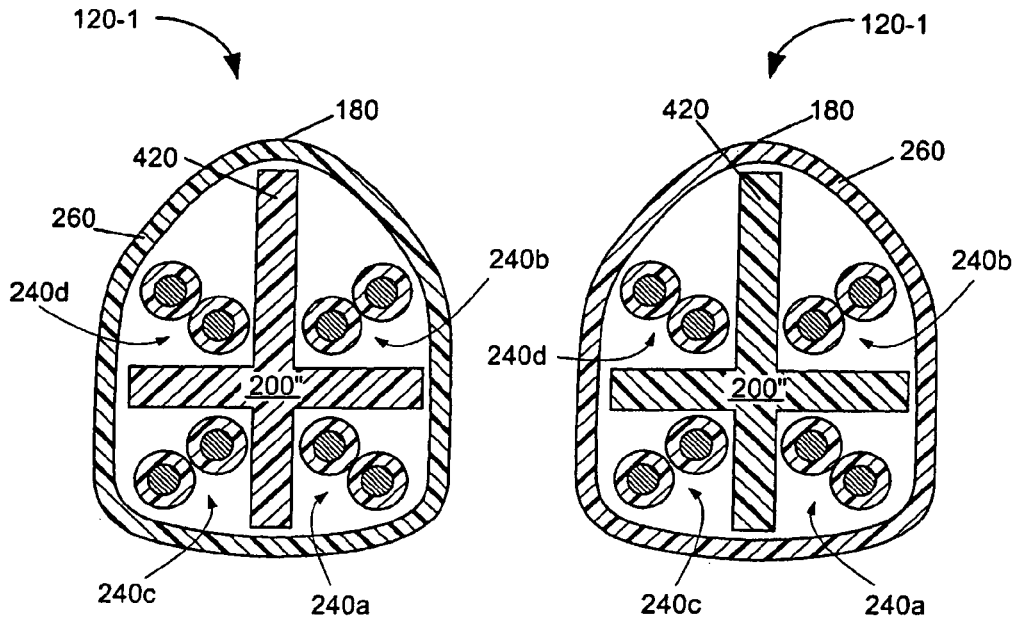
FIG. 11A shows an enlarged cross-sectional view of adjacent cables according to the third embodiment of the invention.

For example, FIG. 11A shows an enlarged cross-sectional view of adjacent cables 120-1 according to the third embodiment of the invention. The adjacent cables 120-1 shown in FIG. 11A include the twisted pairs 240*a*, 240*b*, 240*c*, 240*d*, and each twisted pair 240 having an initial predefined lay length. Assuming that neither of the cables 120-1 shown in FIG. 11A has been subjected to an overall helical twisting, the lay lengths of the twisted pairs 240 of the two cables 120-1 are the same. When the cables 120-1 are positioned adjacent to one another, parallel cross-over points would exist between the corresponding twisted pairs 240 of the cables 120-1, e.g., the twisted pairs 240*d* of each of the cables 120-1. The parallel twisted pairs 240 undesirably enhance the effects of alien crosstalk between the cables 120-1, especially as the cables 120-1 are susceptible to nesting.

However, the lay lengths of the respective twisted pairs 240 of the cables 120-1 can be made dissimilar from each other at any cross-sectional point along a predefined length of the cables 120-1. By applying different overall torsional twist rates to each of the cables 120-1, the cables 120-1 become different, and the initial lay lengths of their respective twisted pairs 240 are changed to resultant lay lengths.

Figure 11B:
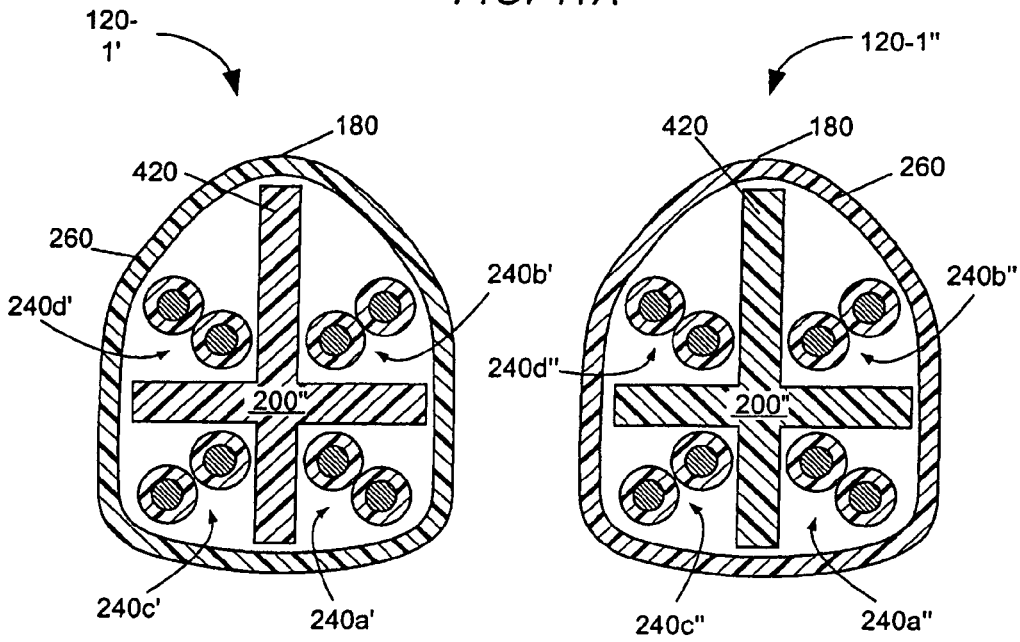
FIG. 11B shows an enlarged cross-sectional view of the adjacent cables of FIG. 11A with a helical twist applied to each of the adjacent cables.

For example, FIG. 11B shows an enlarged cross-sectional view of the cables 120-1 of FIG. 11A after they have been twisted at different overall twist rates. One of the twisted cables 120-1 is now referred to as the cable 120-1', while the other dissimilarly twisted cables 120-1 is now referred to as the cable 120-1". The cable 12-1' and the cable 120-1" are now differentiated by their different cable lay lengths and the different resultant lay lengths of their respective twisted pairs 240. The cable 120-1' includes the twisted pairs 240*a*', 240*b*', 240*c*', 240*d*' (collectively "the twisted pairs 240'"), which twisted pairs 240' include their resultant lay lengths. The cable 120-1" includes the twisted pairs 240*a*", 240*b*", 240*c*", 240*d*" (collectively "the twisted pairs 240"") with their different resultant lay lengths.

The effects of the overall twisting of the cables 120-1 can be further explained by way of numerical examples. In some embodiments, the adjusted, or resultant, lay lengths of the twisted pairs 240, measured in inches, may be approximately obtained by the following formula, where "l" represents the original twisted pair 240 lay length, and "L" represents the cable lay length:

$$l' = \frac{12}{\frac{12}{L} + \frac{12}{l}}$$

Assume that a first of the cables 120-1 includes the twisted pair 240*a* with a predefined lay length of 0.30 inches (7.62 mm), the twisted pair 240*c* with a predefined lay length of 0.40 inches (10.16 mm), the twisted pair 240*b* with a predefined lay length of 0.50 inches (12.70 mm), and the twisted pair 240*d* with a predefined lay length of 0.60 inches (15.24 mm). If the first cable 120-1 is twisted at an overall cable lay length of 4.00 inches to become the cable 120-1', the predefined lay lengths of the twisted pairs 240 are tightened as follows: the resultant lay length of the twisted pair 240*a*' becomes approximately 0.279 inches (7.087 mm), the resultant lay length of the twisted pair 240*c*' becomes approximately 0.364 inches (9.246), the resultant lay length of the twisted pair 240*b*' becomes approximately 0.444 inches (11.278 mm), and the resultant lay length of the twisted pair 240*d*' becomes approximately 0.522 inches (13.259 mm).

1. Minimum Cable Lay Variation

The adjacent cables 120, such as the cables 120-1 in FIG. 11A, can be twisted randomly or non-randomly at dissimilar lay lengths, and the variation between their lay lengths can be limited within certain ranges in order to minimize the occurrences of parallel respective twisted pairs 240 between the cables 120. In the example above in which the first cable 120-1 is twisted at a lay length of 4.00 inches (101.6 mm) to become the cable 120-1', an adjacent second cable 120-1 can be twisted at a dissimilar overall lay length that varies at least a minimum amount from 4.00 inches (101.6 mm) so that the resultant lay lengths of its twisted pairs 240" are not too close to becoming parallel to the twisted pairs 240' of the cable 120-1'.

For example, the second cable 120-1 shown in FIG. 11A can be twisted at a lay length of 3.00 inches (76.2 mm) to become the cable 120-1". At a 3.00 inch (76.2 mm) cable lay length for the cable 120-1", the resultant lay lengths of the cable's 120-1" twisted pairs become the following: 0.273 inches (6.934 mm) for the twisted pair 240*a*", 0.353 inches (8.966 mm) for the twisted pair 240*c*", 0.429 inches (10.897) for the twisted pair 240*b*", and 0.500 inches (12.7 mm) for the twisted pair 240*d*". Greater variations between the cable lay lengths of adjacent cables 120-1', 120-1" result in increased dissimilarity between the lay lengths of the corresponding respective twisted pairs 240', 240" of the cables 120-1', 120-1".

Accordingly, the adjacent cables 120-1 shown in FIG. 11A should be twisted at unique lay lengths that are not too similar to each other's average cable lay lengths along at least a predefined distance, such as a ten meter cable 120 section. By having cable lay lengths that vary at least by a minimum variation, the corresponding twisted pairs 240 are configured to be non-parallel or to not come within a certain range of becoming parallel. As a result, alien crosstalk between the cables 120 is minimized because the corresponding twisted pairs 240 have dissimilar resultant lay lengths, while the corresponding twisted pairs 240 are maintained to not be too close to a parallel lay situation. In some embodiments, the cable lay lengths of the adjacent cables 120 vary no less than a predetermined amount of one another. In some embodiments, the adjacent cables 120 have individual cable lay lengths that vary no less than the predetermined amount from each other's average individual lay length calculated along at least a predefined distance of generally longitudinally extending section. In some embodiments, the predetermined amount is approximately plus or minus ten percent. In some embodiments, the predefined distance is approximately ten meters.

2. Maximum Cable Lay Variation

The adjacent cables 120, such as the cables 120-1', 120-1" shown in FIG. 11B, can be configured to minimize alien crosstalk by having unique cable lay lengths that do not vary beyond a certain maximum variation. By limiting the variation between the lay lengths of the adjacent cables 120-1', 120-1", the non-corresponding respective twisted pairs 240 of the cables 120-1', 120-1", e.g., the twisted pair 240*b*' of the cable 120-1' and the twisted pair 240*d*" of the cable 120-1", are prevented from becoming approximately parallel. In other words, the cable lay variation limit prevents the resultant lay length of the twisted pair 240*d*" of the cable 120-1" from becoming approximately equal to the resultant lay lengths of the cable 120-1' twisted pairs 240*a*", 240*b*", 240*c*". The lay length limitations can be configured so that each of the twisted pair 240' lay lengths of the cable 120-1' equal no more than one of the twisted pair 240" lay lengths of the cable 120-1" at any cross-sectional point along the longitudinal axes of the cables 120-1', 120-1".

Thus, the limit on maximum cable lay variation keeps the adjacent cables' 120 individual twisted pair 240 lay lengths from varying too much. If one of the adjacent cables 120 were twisted too tightly compared to the twist rate of another cable 120, then non-corresponding twisted pairs 240 of the adjacent cables 120 may become approximately parallel, which would undesirably increase the effects of alien crosstalk between the adjacent cables 120.

In the example given above in which the cable 120-1' included an overall cable lay length of 4.00 inches (101.6 mm), the cable 120-1" would be twisted too tightly if it were helically twisted at a cable lay length of approximately 1.71 inches (43.434 mm). At a 1.71 inch (43.434 mm) lay length, the resultant lay lengths of the cable's 120-1" twisted pairs 240" become the following: 0.255 inches (6.477 mm) for the twisted pair 240*a"*, 0.324 inches (8.230 mm) for the twisted pair 240*c"*, 0.287 inches (7.290 mm) for the twisted pair 240*b"*, and 0.444 inches (11.278 mm) for the twisted pair 240*d"*. Although the cables' 120-1', 120-1" corresponding twisted pairs 240', 240" now have a greater variation in their resultant lay lengths than they did when the cable 120-1" was twisted at 3.00 inches (76.2 mm), some of the non-corresponding twisted pairs 240', 240" of the cables 120-1', 120-1" have become approximately parallel. This increases alien crosstalk between the cables 120-1', 120-1". Specifically, the resultant lay length of the cable's 120-1' twisted pair 240*b'* approximately equals the resultant lay length of the cable's 120-1" twisted pair 240*d"*.

Therefore, the cables 120 should be helically twisted such that their individual twist rates do not cause the twisted pairs 240 between the cables 120 to become approximately parallel. This is especially important when overall cable lay lengths are gradually increased or decreased within the ranges specified, as parallel conditions could be evident at some point within the range. For example, the cable 120 lay lengths may be limited to ranges that do not cause their twisted pair 240 lay lengths to go beyond certain resultant lay length boundaries. By twisting the cables 120 only within certain ranges of cable lay lengths, non-corresponding twisted pairs 240 of the cables 120 should not become approximately parallel. Therefore, the adjacent cables 120 can be configured such that the resultant lay length of one of the twisted pairs 240 equals no more than one resultant twisted pair 240 lay length of the other cable 120. For example, only the corresponding twisted pairs 240 of the cables 240 should ever have parallel lay lengths. In some embodiments, the twisted pair 240*d* of one of the adjacent cables 120 will not become parallel to the twisted pairs 240*a*, 24*b*, and 240*c* of another of the adjacent cables 120.

In some embodiments, the maximum variation boundaries for the cable lay length of the cables 120 is established according to maximum variation boundaries for each of the twisted pairs 240 of the cables 120. For example, assume a first cable 120 includes the twisted pairs 240*a*, 240*b*, 240*c*, 240*d* with the following lay lengths: 0.30 inches (7.62 mm)for the twisted pair 240*a*, 0.50 inches (12.7 mm) for the twisted pair 240*c*, 0.70 inches (17.78 mm) for the twisted pair 240*b*, and 0.90 inches (22.86 mm) for the twisted pair 240*d*. The twist rate of the first cable 120 may be limited by certain maximum variation boundaries for the lay lengths of the twisted pairs 240 of the cable 120.

For example, in some embodiments, the lay length of the first cable 120 should not cause the lay length of the twisted pair 240*d* to be less than 0.81 inches (20.574 mm). The resultant lay length of the twisted pair 240*b* should not become less than 0.61 inches (15.494 mm). The resultant lay length of the twisted pair 240*c* should not become less than 0.41 inches (10.414 mm). By limiting the lay lengths of the individual twisted pairs 240 to certain unique ranges, the non-corresponding twisted pairs 240 of the adjacently positioned cables 120 should not become approximately parallel. Consequently, the effects of alien crosstalk are limited between the cables 120.

Thus, the cables 120 can be configured to have cable lay lengths within certain minimum and maximum boundaries. Specifically, the cables 120 should each be twisted within a range bounded by a minimum variation and a maximum variation. The minimum variation boundary helps prevent the corresponding twisted pairs 240 of the cables 120 from being approximately parallel. The maximum variation boundary helps prevent the non-corresponding twisted pairs 240 of the cables 120 from becoming approximately parallel to each other, thereby reducing the effects of alien crosstalk between the cables 120.

3. Random Cable Twist

As discussed above, the cable 120 can be randomly or non-randomly twisted along at least the predefined length. Not only does this encourage distance maximization between adjacent cables 120, it helps ensure that adjacently positioned cables 120 do not have twisted pairs 240 that are parallel to one another. At the least, the varying cable lay length of the cable 120 helps minimize the instances of parallel twisted pairs 240. Preferably, the cable lay length of the cable 120 varies over at least the predefined length, while remaining within the maximum and the minimum cable lay variation boundaries discussed above.

The cable 120 can be helically twisted at a continuously increasing or continuously decreasing lay length so that the lay lengths of its twisted pairs are either continuously increased or continuously decreased over the predefined length such that when the predefined length of cables 120, or the twisted pairs 240, is separated into two sub-sections, and the sub-sections are positioned adjacent to one another, then at any point of adjacency for the sub-sections, the closest twisted pair 240 for each of the sub-sections have different lay lengths. This reduces alien crosstalk by ensuring that closest twisted pairs 240 between adjacent cables 120 have different lay lengths, i.e., are not parallel.

When the cable 120 undergoes an overall twisting, a torsional twist rate is applied uniformly to the twisted pairs 240 at any particular point along the predefined length. However, because the initial lay length is a factor in the equation discussed above, the change from the initial lay length to the resultant lay length of each of the twisted pairs 240 will be slightly different. FIG. 1 shows two adjacent cables 120 that are individually twisted at different lay lengths.

Figure 12:
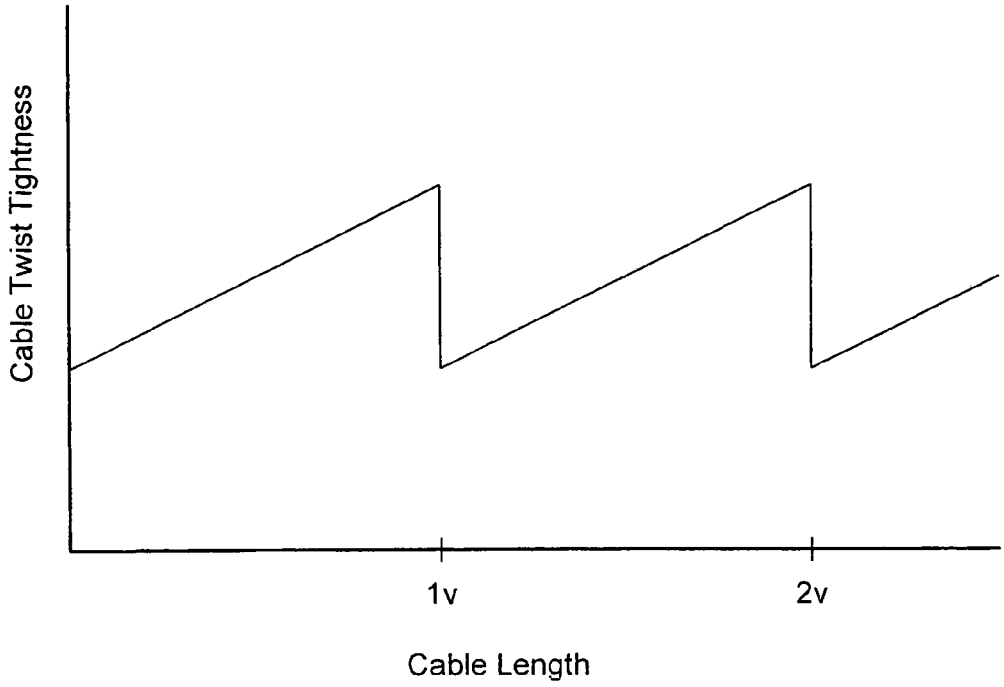
FIG. 12 shows a chart of a variation of twist rate applied over a length of the cable 120 according to one embodiment.

FIG. 12 shows a chart of a variation of twist rate applied to the cable 120 according to one embodiment. The horizontal axis represents a length of the cable 120, separated into predefined lengths. The vertical axis represents the tightness of overall cable 120 twist. As shown in FIG. 12, the twist rate is continuously increased over a certain length (v) of the cable 120, preferably over the predefined length. At the end of the certain length (1*v*), the twist rate quickly returns to a looser twist rate and continuously increases for at least the next predefined length (2*v*). This twist pattern forms the saw-tooth chart shown in FIG. 12. By varying the twist rate as shown in FIG. 12, any section of the cable 120 along the predefined length can be separated into sections, which sections do not share an identical twist rate.

The cable lay length should be varied at least over the predefined length. Preferably, the predefined length equals at least approximately the length of one fundamental wavelength of a signal being transmitted over the cable 120. This gives the fundamental wavelength enough length to complete a full cycle. The length of the fundamental wavelength is dependent upon the frequency of the signal being transmitted. In some exemplary embodiments, the length of the fundamental wavelength is approximately three meters. Further, it is well known that events of a cyclical nature are additive, and multiple wavelengths are needed to see if cyclical issues exist. However, by insuring some form of randomness over a one to three wavelength distance, cyclical issues can be minimized or even potentially eliminated. In some embodiments, inspection of longer wavelengths is needed to insure randomness.

Thus, in some embodiments, the predefined length is at least approximately the length of one fundamental wavelength but no more than approximately the length of three fundamental wavelengths of a signal being transmitted. Therefore, in some embodiments, the predefined length is approximately three meters. In other embodiments, the predefined length is approximately ten meters.

J. Performance Measurements

In some embodiments, the cables 120 can propagate data at throughputs approaching and surpassing 20 gigabits per second. In some embodiments, the Shannon capacity of one-hundred meter length cable 120 is greater than approximately 20 gigabits per second without the performance of any alien crosstalk mitigation with digital signal processing.

For example, in one embodiment, the cabled group 100 comprises seven cables 120 positioned longitudinally adjacent to each other over approximately a one-hundred meter length. The cables 120 are arranged such that one centrally positioned cable 120 is surrounded by the other six cables 120. In this configuration, the cables 120 can transmit high-speed data signals at rates approaching and surpassing 20 gigabits per second.

VI. Alternative Embodiments

The above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in cable configurations, and that the invention will be incorporated into such future embodiments.

What is claimed is:

1. A cable, comprising:

a) a plurality of twisted pairs of conductors;

b) a non-conductive filler including a base, a first extension located a distance from a center of the base, and a second extension located at an end of the base opposite from the first extension, the first extension being located a distance farther from the center of the base than the second extension, the base defining a number of regions, each of the regions receiving one of the pairs of the plurality of twisted pairs of conductors; and c) a jacket that surrounds the plurality of twisted pairs of conductors and the filler, the first extension of the filler creating a ridge at an exterior of the jacket that extends along a length of the cable.

2. The cable of claim 1, wherein the filler twists along the length of the cable such that the ridge created by the extension is helical.

3. The cable of claim 1, wherein the base includes a plurality of legs, the regions for receiving the twisted pairs of conductors being located between the legs.

4. The cable of claim 3, wherein at least some of the legs have different lengths, and wherein the first extension includes an enlargement located at an end of one of the legs.

5. The cable of claim 1, wherein the number of regions includes three or more regions that each receive one of the pairs of the plurality of twisted pairs of conductors.

6. The cable of claim 1, wherein the first and second extensions have a non-symmetrical orientation relative to the center of the base.

7. The cable of claim 1, wherein each of the pairs of the plurality of twisted pairs of conductors is located within a portion of a circular cross-sectional area of the cable when positioned within the regions defined by the base, and wherein at least a portion of the first extension extends beyond the portion of the cross-sectional area.

8. The cable of claim 1, wherein the base and the first extension of the filler are an integral construction.

9. A cable, comprising:

a) a plurality of twisted pairs of conductors; and b) a non-conductive filler that twists about a central axis of the cable, the non-conductive filler including a base portion and a filler extension, the base portion defining a number of pockets, each of the pockets receiving one of the pairs of the plurality of twisted pairs of conductors; and c) a jacket that surrounds the plurality of twisted pairs of conductors and the filler;

d) wherein the plurality of twisted pairs of conductors is located within a portion of a cross-sectional area of the cable, and at least a filler portion of the filler extension extending beyond the portion of the cross-sectional area to create a helical ridge in the jacket; and e) wherein one of the pairs of the plurality of twisted pairs of conductors defines a diameter, the filler portion of the filler extension extending beyond the portion of the cross-sectional area a distance of at least approximately one-quarter of the diameter.

10. The cable of claim 9, wherein the base portion includes a plurality of legs, the legs defining at least some of the number of pockets that receive the twisted pairs of conductors.

11. The cable of claim 9, wherein the base portion and the filler extension are an integral construction.

12. A cable, comprising:

a) a plurality of twisted pairs of conductors;

b) a first filler component having dividers that define a number of regions, each of the pairs of the plurality of twisted pairs of conductors being positioned within one of the number of regions, the plurality of twisted pairs of conductors being located within a portion of a cross-sectional area of the cable;

c) a second filler component having at least a filler portion located outside the portion of the cross-sectional area; and d) a jacket that surrounds the plurality of twisted pairs of conductors and the first and second filler components;

e) wherein the filler portion of the second filler component located outside the portion of the cross-sectional area creates a helical ridge in the jacket; and f) wherein one of the pairs of the plurality of twisted pairs of conductors defines a diameter, the filler portion of the second filler component extending beyond the portion of the cross-sectional area a distance of at least approximately one-quarter of the diameter.

13. The cable of claim 12, wherein the first filler component and the second filler component are an integral construction.

14. The cable of claim 12, wherein each of the first and second filler components is non-conductive.

15. A cable comprising:

a jacket;

a plurality of twisted pairs of conductors positioned within the jacket;

a filler arrangement positioned within the jacket, the filler arrangement including:

a first non-conductive structure that extends along a length of the cable, the first non-conductive structure including dividers that separate the twisted pairs of conductors; and a second non-conductive structure that extends along a length of the cable, the second non-conductive structure forming a helical ridge in the jacket, wherein the helical ridge projects outwardly from a main outer boundary of the jacket, and wherein each twisted pair of conductors defines a diameter, the helical ridge projecting outwardly from the main outer boundary of the jacket a distance at least equal to one-quarter the diameter defined by each twisted pair of conductors.

16. The cable of claim 15, wherein the first and second non-conductive structures are integral with one another.

17. The cable of claim 15, wherein the first non-conductive structure turns in a helix as the first non-conductive structure extends along the length of the cable.

18. The cable of claim 15, wherein the first and second non-conductive structures are integrally connected with one another, and wherein the first and second non-conductive structures turn in a helix as the conductive structures extend along the length of the cable.

19. The cable of claim 18, wherein the first non-conductive structure includes a core and a plurality of legs that project radially outwardly from the core, and wherein the second non-conductive structure includes a first enlargement integral with an end of a first one of the legs.

20. The cable of claim 19, wherein the plurality of twisted pairs of conductors include first and second twisted pairs of conductors located at opposite sides of the first leg, wherein the first and second twisted pairs of conductors each define diameters, and wherein the first enlargement projects outwardly beyond each of the diameters a distance at least equal to one-quarter of either of the diameters.

21. A cable comprising:

a jacket;

a plurality of twisted pairs of conductors positioned within the jacket;

a filler arrangement positioned within the jacket, the filler arrangement including:

a first non-conductive structure that extends along a length of the cable, the first non-conductive structure including dividers that separate the twisted pairs of conductors; and a second non-conductive structure that extends along a length of the cable, the second non-conductive structure forming a helical ridge in the jacket;

wherein the first and second non-conductive structures are integrally connected with one another, and wherein the first and second non-conductive structures turn in a helix as the conductive structures extend along the length of the cable;

wherein the first non-conductive structure includes a core and a plurality of legs that project radially outwardly from the core, and wherein the second non-conductive structure includes a first enlargement integral with an end of a first one of the legs; and wherein the plurality of twisted pairs of conductors include first and second twisted pairs of conductors located at opposite sides of the first leg, wherein the first and second twisted pairs of conductors each define diameters, and wherein the first enlargement projects outwardly beyond each of the diameters a distance at least equal to one-quarter of either of the diameters.

22. The cable of claim 21, wherein the helical ridge projects outwardly from a main outer boundary of the jacket, and wherein the helical ridge projects outwardly from the main outer boundary of the jacket a distance at least equal to one-quarter the diameter defined by each twisted pair of conductors.

* * * * *